US006236159B1

(12) United States Patent
Inoue et al.

(10) Patent No.: US 6,236,159 B1
(45) Date of Patent: May 22, 2001

(54) GAS DISCHARGE PANEL HAVING GAS FLOW BARRIERS AND EVACUATION METHOD THEREOF

(75) Inventors: Kazunori Inoue; Fumihiro Namiki; Keiichi Betsui; Shinya Fukuta; Tadayoshi Kosaka, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/087,503

(22) Filed: May 29, 1998

(30) Foreign Application Priority Data

Dec. 26, 1997 (JP) ..... 9-360771

(51) Int. Cl.[7] ..... H01J 17/49

(52) U.S. Cl. ..... 313/582; 313/493; 313/584; 313/609; 313/586; 445/59; 445/42

(58) Field of Search ..... 313/493, 581, 313/584, 46, 573, 610, 585, 609; 445/6, 42, 59

(56) References Cited

U.S. PATENT DOCUMENTS 5,032,768 * 7/1991 Lee et al. ..... 313/582
5,260,624 * 11/1993 Kim et al. ..... 313/584
5,384,514 * 1/1995 Kim ..... 313/585
5,493,175 * 2/1996 Kani ..... 313/584
5,541,479 * 7/1996 Nagakubo ..... 313/584
5,747,931 * 5/1998 Riddle et al. ..... 313/584
5,825,128 * 10/1998 Betsui et al. ..... 313/584
5,903,096 * 5/1999 Winsor ..... 313/493
5,925,203 * 7/1999 Riddle et al. ..... 313/581
5,959,403 * 9/1999 Lee ..... 313/584
5,990,616 * 11/1999 Lee et al. ..... 313/584

FOREIGN PATENT DOCUMENTS 5-234512 9/1993 (JP) .

* cited by examiner

*Primary Examiner*—Michael H. Day
*Assistant Examiner*—Mariceli Santiago
(74) *Attorney, Agent, or Firm*—Staas & Halsey LLP

(57) ABSTRACT

The gas discharge panel according to the present invention includes a pair of substrates, a plurality of barrier ribs, a sealing member, and two gas flow barriers. One of the substrates has a first vent hole and a second vent hole provided in a peripheral portion thereof for intercommunication between the inside and outside of the panel. The at least two gas flow barriers are provided between the sealing member and the barrier ribs located on opposite sides of an arrangement of the barrier ribs so that a gas introduced from the first vent hole flows through inter-rib spaces defined between adjacent pairs of barrier ribs and is expelled from the second vent hole.

16 Claims, 37 Drawing Sheets

GAS DISCHARGE PANEL HAVING GAS FLOW BARRIERS AND EVACUATION METHOD THEREOF

CROSS-REFERENCE TO RELATED APPLICATION

This application is related to Japanese application No. Hei 9(1997)-360771, filed on Dec. 26, 1997 whose priority is claimed under 35 USC §119, the disclosure of which is incorporated by reference in its entirety.

BACKGROUND OF THE INVENTION

1. Field of the Invention

The present invention relates to a gas discharge panel in which electric discharges are generated across electrodes in an enclosed gas, such as a plasma display panel, and an evacuation method therefor. More particularly, the invention relates to a structure of a gas discharge panel which facilitates gas evacuation and gas introduction in the fabrication of the panel and to an evacuation method therefor.

2. Description of the Prior Art

Gas discharge panels are self-luminous panels which have an electric discharge space defined between a pair of substrates spaced a minute distance in an opposed relation with the periphery thereof being sealed with a sealing member of a sealer, and are applied to plasma display panels (PDPs) for wall-mount TVs.

PDPs capable of color display typically have a display area defined within an electric discharge space partitioned by barrier ribs. In a matrix-addressable Ac-driven PDP of the triode surface discharge type, for example, a plurality of elongate barrier ribs each having a height of about 100 $\mu$m to about 200 $\mu$m and a width of about 30 $\mu$m to about 50 $\mu$m are arranged parallel to each other at an interval of about 200 $\mu$m in a striped configuration within the display area. A non-display area having a width of about 1 cm to about 3 cm, for example, is provided adjacent to a sealing member to surround the display area in which the barrier ribs are formed, for prevention of contamination by gases emanating from the sealing member.

The electric discharge space partitioned by the barrier ribs is filled with a discharge gas such as Xe or Ne.

The introduction of the discharge gas is typically achieved in the following manner. As shown in FIG. 33, a rear substrate 52 formed with barrier ribs 51 has a vent hole 54 formed in a corner thereof within an area to be surrounded by a sealing member 53. As shown in FIG. 34A, a sealer 56 of a low melting point glass is applied on a peripheral portion of a front substrate 55 for formation of the sealing member 53, and then the front substrate 55 and the rear substrate 52 are combined together with the sealer 56 melted by application of heat. In this heating process, a glass vent pipe 57 is attached to the vent hole 54 formed in the rear substrate 52 by using the low melting point glass as an adhesive.

Thereafter, impurity gases are expelled from the resulting panel through the attached vent pipe 57 as shown in FIG. 34B. Then, the discharge gas is introduced into an electric discharge space of the panel from the same vent pipe 57 as shown in FIG. 34C and, when the internal pressure of the panel reaches a desired level, the opening of the distal end of the vent pipe 57 is sealed. Thus, a PDP is completed.

In the case of the PDP having the barrier ribs arranged in a striped configuration in the electric discharge space, however, the barrier ribs obstruct gas flow in the electric discharge space during the evacuation and the gas introduction. More specifically, since the gas flow conductance (easiness of gas flow) of an inter-rib space (elongate cavity) defined between each adjacent pair of ribs is lower than the gas flow conductance of a peripheral space defined between the sealing member 53 and a barrier rib formation area, the impurity gases to be expelled from the panel flow through the peripheral space as indicated by arrows S in FIG. 35 when the panel is evacuated. Similarly, the discharge gas introduced into the electric discharge space flows through the peripheral space as indicated by arrows T in FIG. 36.

The impurity gases and the discharge gas mainly flow through the peripheral space in the PDP, and only a little portion thereof flows through the inter-rib spaces. Therefore, the impurity gases emanating from the barrier ribs, the sealing member and the like due to the heat applied during the panel sealing process cannot sufficiently be expelled from the inter-rib spaces, so that the impurity gases remain in the inter-rib spaces and are re-adsorbed on the interior surface of the panel. In the case of the AC-driven PDP, the impurity gases contaminate a protection film of MgO, thereby deteriorating the display characteristics of the PDP. This problem may be solved by performing the impurity gas expelling operation for a prolonged time, but the time required for the panel fabrication is increased, resulting in a lower productivity.

In the case of the PDP having the stripe barrier ribs, the nonuniform gas flow conductance attributable to the internal structure of the PDP makes it impossible to completely remove the impurity gases from the PDP in a short time by an evacuation method utilizing a pressure difference.

As a method for forcibly removing the impurity gases remaining in the inter-rib spaces, a method is proposed in which the impurity gases are expelled by way of gas exchange by introducing a cleaning gas into the panel while heating the panel (see Japanese Unexamined Patent Publication No. Hei 5(1993)-234512).

More specifically, two vent holes are formed in a diagonally opposite relation in the rear substrate of the panel. The impurity gases are expelled from one of the vent holes and the cleaning gas is introduced from the other vent hole while the panel is heated.

However, this method also fails to completely remove the impurity gases remaining in the inter-rib spaces because the impurity gases and the cleaning gas flow through the peripheral space rather than through the inter-rib spaces as indicated by arrows U in FIG. 37. Hence, there is a demand for a technique by which the impurity gases can completely be removed from the PDP having the stripe barrier ribs.

SUMMARY OF THE INVENTION

In view of the foregoing, the present invention is directed to a gas discharge panel and an evacuation method therefor which ensure complete removal of impurity gases and smooth introduction of a discharge gas in inter-rib spaces of the panel by providing a gas flow barrier in a peripheral space of the panel to allow the inter-rib spaces to have a greater gas flow conductance than the peripheral space.

In accordance with one aspect of the present invention, there is provided a gas discharge panel comprising a pair of substrates defining an electric discharge space therebetween, a plurality of barrier ribs arranged parallel to each other in a striped configuration within a display area in the electric discharge space for partitioning the electric discharge space, a sealing member provided between the pair of substrates on the periphery thereof, and at least two gas flow barriers, wherein one of the substrates has a first vent hole and a second vent hole provided in a peripheral portion thereof for intercommunication between the inside and outside of the panel, and the at least two gas flow barriers are provided between the sealing member and the barrier ribs located on opposite sides of an arrangement of the barrier ribs so that a gas introduced from the first vent hole flows through inter-rib spaces defined between adjacent pairs of barrier ribs and is expelled from the second vent hole.

The gas introduced from the first vent hole is likely to flow through a peripheral space between the sealing member and the barrier ribs within the panel because the peripheral space is larger than the inter-rib spaces. With this arrangement, however, the gas flow barriers are provided in the peripheral space so as to hinder the gas from flowing through the peripheral space. Therefore, the gas flows through the inter-rib spaces and is forcibly expelled from the second vent hole. Thus, impurity gases remaining in the inter-rib spaces can completely be expelled from the electric discharge space, and a discharge gas can smoothly be introduced into the inter-rib spaces.

DETAILED DESCRIPTION OF THE PREFERRED EMBODIMENTS

Figure 1:
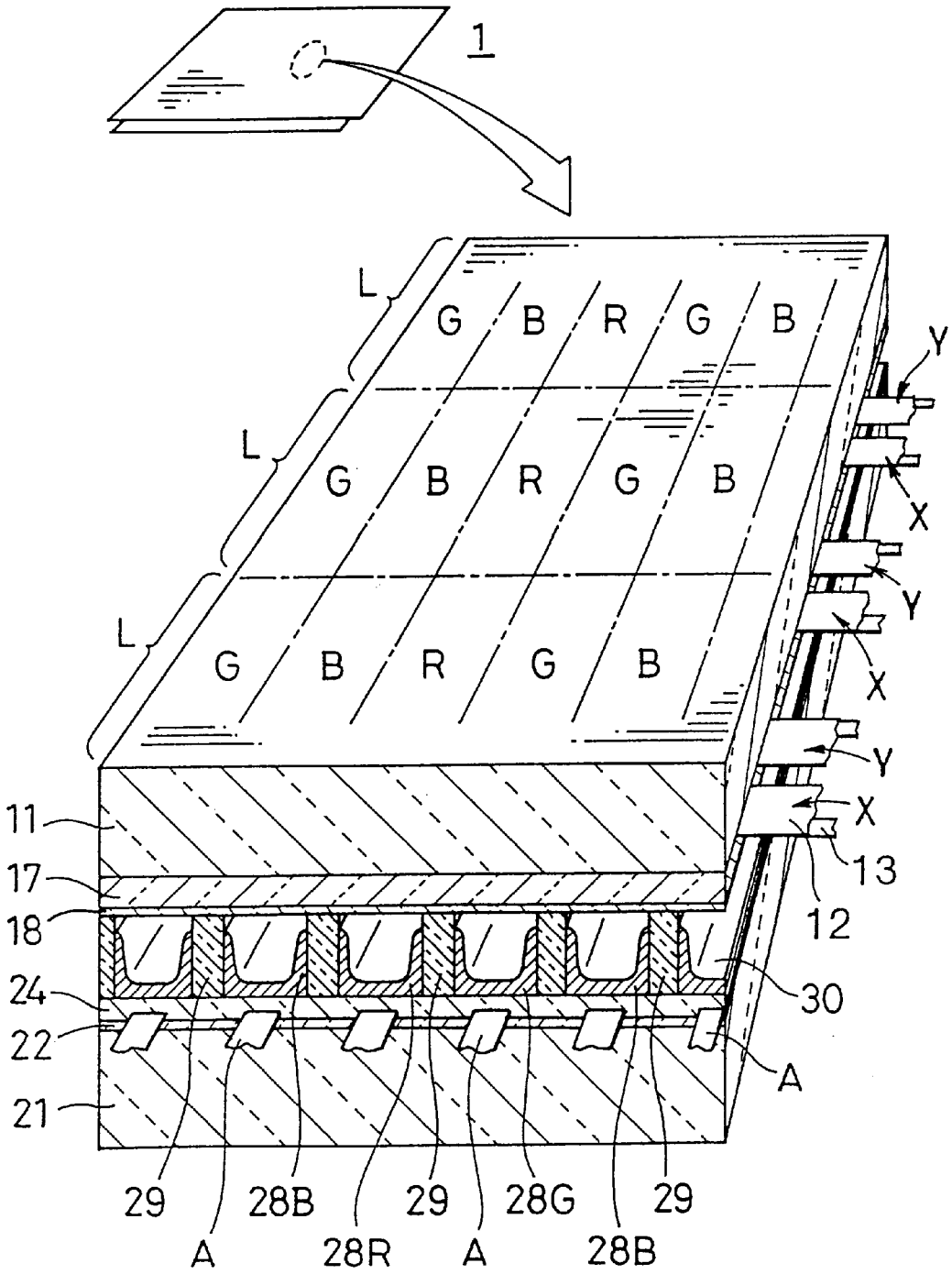
FIG. 1 is a perspective view illustrating the construction of an AC-driven PDP for color display in accordance with the present invention.

A gas discharge panel according to the present invention is of the type which includes a plurality of barrier ribs arranged parallel to each other in a striped configuration within a display area in an electric discharge space defined between a pair of substrates for partitioning the electric discharge space, and a sealing member provided on the periphery of the panel. The gas discharge panel further includes a first vent hole and a second vent hole formed in a peripheral portion of the panel for intercommunication between the inside and outside of the panel, and at least two gas flow barriers provided between the sealing member and barrier ribs located on opposite sides of the arrangement of the barrier ribs so that a gas introduced from the first vent hole flows through inter-rib spaces defined between adjacent pairs of barrier ribs and is expelled from the second vent hole.

Usable as the substrates in the present invention are any of known glass substrates commonly used for conventional gas discharge panels such as PDPs.

The plurality of barrier ribs each have a linear configuration or a waved configuration in plan, and are arranged parallel to each other so as to allow the gas to flow through the inter-rib spaces. The sectional configuration of each of the barrier ribs is not particularly limited. The barrier ribs may be made of any of known materials commonly used for the conventional gas discharge panels. The sealing member may be made of any of known sealers commonly used for the conventional gas discharge panels.

Vent pipes are fitted to the vent holes. The vent holes and the vent pipes allow the gas to flow in and out of the panel. For example, the vent holes may be formed in the sealing member between the substrates and fitted with the vent pipes so that the vent pipes project from the side faces of the panel. The formation of the vent holes can be achieved by a conventionally known method.

As described above, the two gas flow barriers are provided between the sealing member and a barrier rib located on one side of the barrier rib arrangement and between the sealing member and a barrier rib located on the other side of the barrier rib arrangement. These gas flow barriers maybe formed at the stage of formation of the barrier ribs, at the stage of formation of the sealing member or at the stage between the formation of the barrier ribs and the formation of the sealing member. Any of known barrier materials may be used as a material for the gas flow barriers. For example, the gas flow barriers may be made of the same material as the material for the barrier ribs or the sealing member.

The gas to be introduced from the first vent hole may be any kind of gases, e.g., a cleaning gas and a discharge gas, and is used for expelling impurity gases emanating from the barrier ribs, the sealing member and the like during the sealing of the periphery of the panel.

The first vent hole and the second vent hole may be located in a diagonally opposite relation in the panel, and a plurality of gas flow barriers may be provided in a staggered manner between the respective barrier ribs and either of opposed interior surfaces of the sealing member so that the gas can flow through the inter-rib spaces successively.

Alternatively, the first vent hole and the second vent hole may be located in juxtaposition adjacent to one side of the panel, and a plurality of gas flow barriers may be provided in a staggered manner between the respective barrier ribs and either of the opposed interior surfaces of the sealing member so that the gas can flow through the inter-rib spaces successively.

Further, the first vent hole and the second vent hole may be located in a diagonally opposite relation in the panel, and the gas flow barriers may respectively be provided adjacent to the first vent hole between the sealing member and one end of a barrier rib located on one side of the barrier rib arrangement and adjacent to the second vent hole between the sealing member and one end of a barrier rib located on the other side of the barrier rib arrangement.

The first vent hole may include a pair of vent holes which are located in juxtaposition adjacent to one of opposed sides of the panel, and the second vent hole may include a pair of vent holes which are located in juxtaposition adjacent to the other side of the panel. That is, four vent holes are provided in four corners of the panel, and the gas flow barriers may be provided between the sealing member and side faces of the barrier ribs located on the opposite sides of the barrier rib arrangement.

These gas flow barriers may be formed integrally with the corresponding barrier ribs or the sealing member. That is, the gas flow barriers may be made of the same material as the material for the barrier ribs or the sealing member.

A cleaning electrode for causing electric discharge to ionize the gas for cleaning the electric discharge space may be provided adjacent to the first vent hole in a peripheral space between the barrier ribs and the sealing member. In this case, the cleaning electrode may include a pair of electrodes arranged parallel to each other perpendicularly to the barrier ribs.

Where one of the substrates has address electrodes arranged parallel to the barrier ribs on an interior surface thereof, the cleaning electrode may be provided perpendicularly to the barrier ribs on an interior surface of the other substrate. In this case, the electric discharge is caused between the cleaning electrode and the address electrodes for the cleaning of the electric discharge space of the panel.

In accordance with the present invention, consideration is given to the internal construction of the gas discharge panel for forcibly expelling the impurity gases from the panel by passing the cleaning gas. More specifically, the internal construction of the gas discharge panel is designed such that a plurality of vent holes including the first and second vent holes are provided in one of the pair of substrates of the panel for intercommunication between the inside and outside of the panel and the gas flow conductance of the inter-rib spaces is made greater than the gas flow conductance of the peripheral space when the gas introduced from at least the first vent hole is expelled from the second vent hole.

A getter such as of a material capable of adsorbing the impurity gases of interest may be provided within the panel. In this case, the internal construction of the panel may be designed so that the gas flow conductance around the getter is greater than the gas flow conductance of the peripheral space.

After fabrication of the panel, an evacuation and gas introduction process is performed in the following manner.

The panel is evacuated from at least one or the vent holes. The impurity gases are caused to be released from the barrier ribs, the sealing member and the like in the panel and expelled from the inter-rib spaces by some means. The release of the impurity gases may be achieved, for example, by heating the panel or by causing electric discharge between discharge electrodes or between the cleaning electrodes while introducing the gas into the panel. These methods may be employed in combination.

The impurity gases remaining in the inter-rib spaces within the panel are forcibly expelled from the second vent hole by introducing the discharge gas or the cleaning gas, e.g., $N_2$, Ne, He, Ar or a gas mixture thereof, into the panel from the first vent hole. Alternatively, the impurity gases may be removed from the inter-rib spaces by guiding the impurity gases to the getter to allow the getter to absorb the impurity gases. Thereafter, the introduction of the gas is stopped, while the panel is continuously evacuated. This operation may be repeated several times as required.

After the aforesaid operation, the panel is cooled to room temperature, and the evacuation is stopped. Then, the discharge gas is introduced into the panel until the internal pressure of the panel reaches a desired level, and the vent pipes attached to the panel are sealed.

This arrangement offers the following effects. The concentration of the impurity gases can be reduced thereby to improve the display characteristics of the panel. Since the impurity gases can forcibly be expelled from the panel by the introduction of the gas, the time required for the removal of the impurity gases in the evacuation and gas introduction process can be shortened in comparison with the case where the removal of the impurity gases is achieved simply by vacuum evacuation. Thus, the productivity can be improved.

In accordance with the present invention, the cleaning electrodes are provided in the panel, and the cleaning of the electric discharge space within the panel is achieved by causing electric discharge in the panel during the evacuation process.

In the evacuation process, the panel is evacuated while being heated. Then, electric discharge is caused between the cleaning electrodes in the panel, and the gas to be introduced into the panel is preliminarily activated (i.e., ionized) into plasma gas. As previously described, the gas to be introduced into the panel is a discharge gas or a cleaning gas which does not adversely affect the display characteristics of the panel when ionized by the electric discharge, and examples thereof include $N_2$, Ne, He, Ar and gas mixtures thereof. The active plasma gas introduced into the panel is utilized for removal of impurities from the electric discharge space (display area) . At this time, the electric discharge within the panel may be induced by the active plasma gas.

The arrangement of the electrodes for the electric discharge for the cleaning of the electric discharge space is as follows. The cleaning electrodes to be used only in the evacuation and gas introduction process are provided adjacent to the first vent hole in the peripheral space (between the sealing member and the barrier ribs) which is irrelevant to the display.

The cleaning electrodes are provided outside the display area in the peripheral space which is larger than the inter-rib spaces and, hence, the electric discharge more easily occurs in the peripheral space. Since the peripheral space is irrelevant to the display, the cleaning electrodes may have such a shape that the electric discharge can more easily occur in the peripheral space than in the display area. The cleaning electrodes may be provided either on the same substrate or on the opposed substrates. Electric discharge in the entire electric discharge space is induced by the plasma gas activated by the electric discharge in the peripheral space. As previously described, the gas may preliminarily be ionized into the plasma gas by the electric discharge before the introduction of the gas, so that the electric discharge can readily be initiated outside the display area in the peripheral space in the panel.

To facilitate the removal of the impurities, the panel may be evacuated under the electric discharge while the gas is introduced therein. In this case, the internal construction of the panel is preferably designed so as to ensure smooth flow of the gas in the panel. For example, the aforesaid panel construction having the gas flow barriers is preferably employed.

In this case, the barrier ribs may be arranged in a striped configuration or in a meshed configuration on the front substrate. The electric discharge is first caused outside the display area in the peripheral space by the cleaning electrodes for induction of the electric discharge in the display area, and then the electric discharge is caused in the display area by the electrodes provided within the display area in the panel.

The cleaning operation for the electric discharge space in the panel may be repeated any number of times as required. After completion of the aforesaid process, the panel is cooled to room temperature, and the vent pipe fitted to the second vent hole is sealed. In turn, the discharge gas is introduced into the panel through the first vent hole until the internal pressure of the panel reaches the desired level, and then the vent pipe fitted to the first vent hole is sealed. At this time, the gas to be introduced may preliminarily be ionized into plasma gas by the electric discharge.

This arrangement offers the following advantages. Since the panel can satisfactorily be evacuated even at a low temperature by causing the electric discharge in the electric discharge space in the panel, the time required for the evacuation and gas introduction process can be shortened in comparison with the prior art, thereby improving the productivity.

The present invention will hereinafter be described in greater detail by way of embodiments thereof with reference to the attached drawings. It should be understood that the invention is not limited to these embodiments. In the following explanation, an AC-driven PDP for color display is employed as the gas discharge panel.

FIG. 1 is a perspective view illustrating the construction of the AC-driven color PDP according to the present invention.

In the AC-driven color PDP 1 shown in FIG. 1, a pair of sustain electrodes X and Y for each matrix line L are disposed on an interior surface of a front glass substrate (hereinafter referred to as "front substrate") 11. The sustain electrodes X and Y each include a transparent electrode 12 and a metal electrode 13, and are covered with a dielectric layer 17, which is further covered with a protective layer 18 of magnesium oxide (MgO).

A base layer 22, address electrodes A and an insulating layer 24 are provided in this order on an interior surface of a rear glass substrate (hereinafter referred to as "rear substrate") 21. Elongate barrier ribs 29 are provided between the respective address electrodes A as standing upright on the insulating layer 24. Three color (R, G, B) fluorescent layers 28R, 28G and 28B are respectively provided in inter-rib spaces defined between the elongate barrier ribs 29. Each pixel (picture element) for display is constituted by three subpixels aligning along the matrix line L. The barrier ribs partition an electric discharge space 30 on a subpixel-by-subpixel basis along the matrix line, and define the height of the electric discharge space.

As shown in FIG. 1, the PDP (hereinafter sometimes referred to simply as "panel") 1 has a construction such that the front substrate 11 having the sustain electrodes X and Y for sustaining electrical discharge for the display is combined with the rear substrate 21 having the address electrodes A for causing electric discharge for addressing a display spot, the barrier ribs 29 for physically partitioning the electric discharge space and the fluorescent layers 28R, 28G and 28B.

The internal construction of the PDP 1 will hereinafter be described in detail by way of first to tenth embodiments thereof.

First Embodiment

Figure 2:
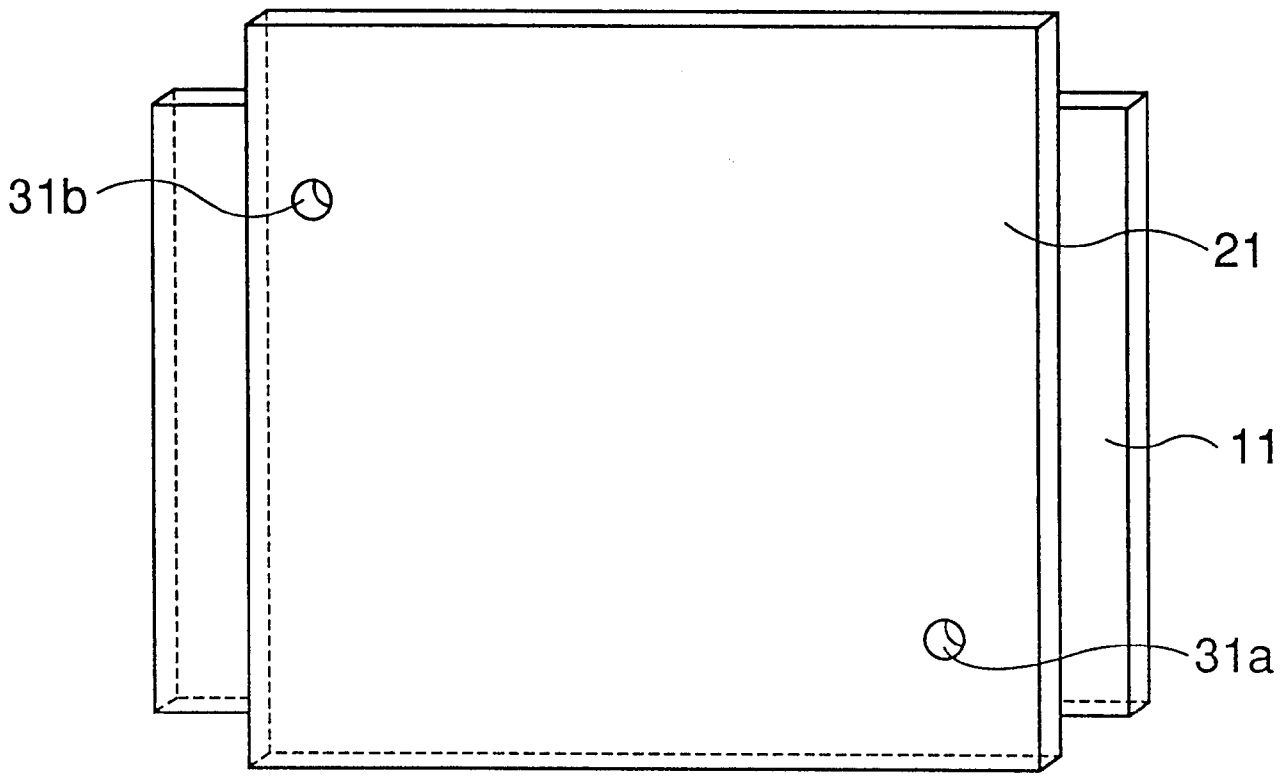
FIG. 2 is a perspective view illustrating the exterior of a PDP according to a first embodiment of the present invention.

FIG. 2 is a perspective view illustrating the exterior of a PDP according to the first embodiment. As shown, two vent holes 31a and 31b are provided in a diagonally opposite relation in the rear substrate 21 as extending through the rear substrate 21.

Figure 3:
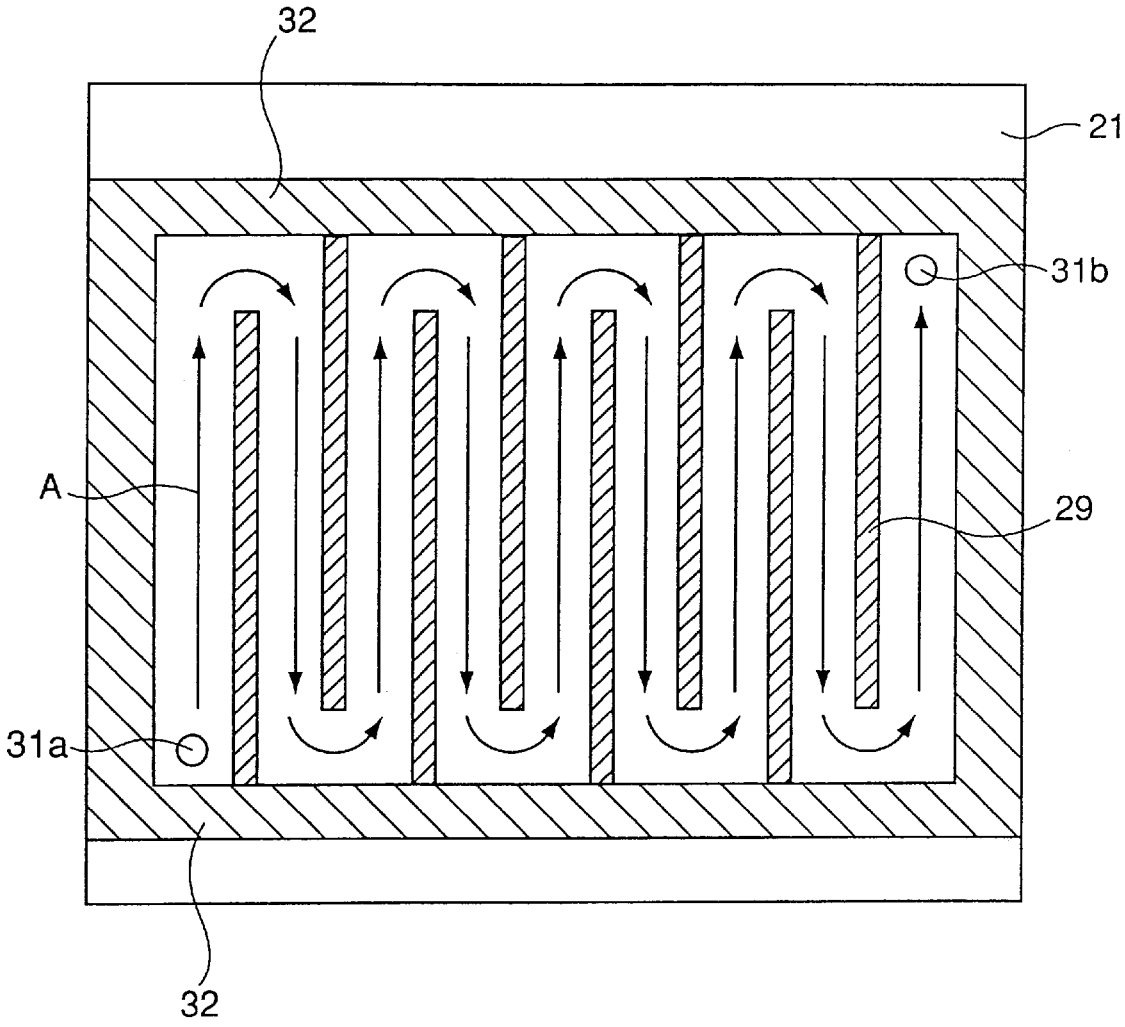
FIG. 3 is an explanatory diagram illustrating the internal construction of the PDP according to the first embodiment.

Barrier ribs are arranged parallel to each other in a striped configuration as shown in FIG. 3. More specifically, one end of a barrier rib located leftmost as seen in FIG. 3 is extended toward one of opposed interior surfaces of a sealing member 32 adjacent to the lower left vent hole 31*a*, and one end of a barrier rib adjacent to the leftmost barrier rib is extended in a direction opposite to the leftmost barrier rib toward the other interior surface of the sealing member. Each adjacent pair of barrier ribs are arranged in this manner, so that the barrier ribs are arranged in a staggered manner. The number of the barrier ribs is properly selected so that one end of a barrier rib 29 located rightmost as seen in FIG. 3 is extended toward the other interior surface of the sealing member adjacent to the upper right vent hole 31*b*. The sealing member 32 is made of a known sealer.

Small gaps are present between the extended ends of the respective barrier ribs 29 and the corresponding interior surfaces of the sealing member 32. The gaps each have a gas flow conductance (also referred to as "evacuation conductance") smaller than the gas flow conductance of a space between the sealing member and the other end of the barrier rib. The small gaps may be filled so that the extended ends of the barrier ribs 29 abut against the corresponding interior surfaces of the sealing member 32.

The barrier ribs each have a linear configuration in this embodiment, but may be of a waved configuration in plan.

The rear substrate 21 having such a construction is combined with the front substrate 11, and glass vent pipes are fitted to the vent holes 31*a* and 31*b*.

Second Embodiment

Figure 4:
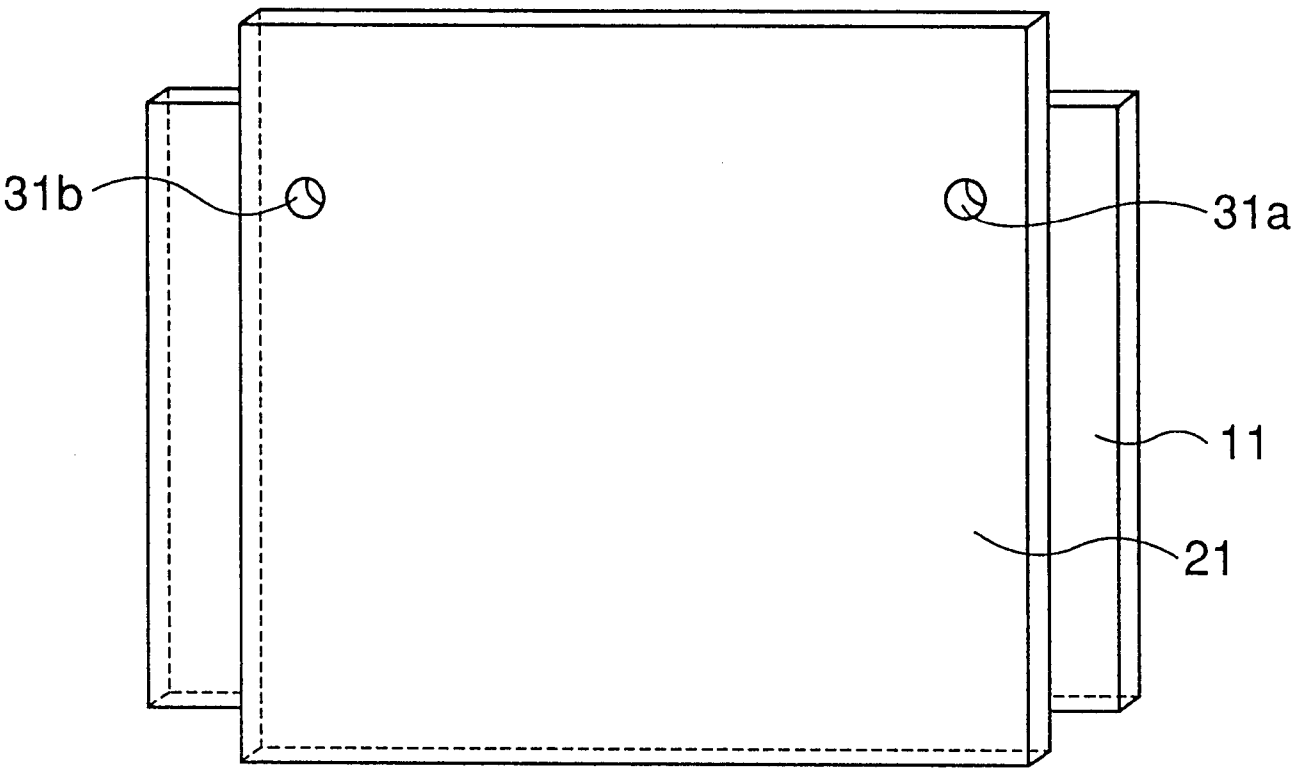
FIG. 4 is a perspective view illustrating the exterior of a PDP according to a second embodiment of the present invention.

FIG. 4 is a perspective view illustrating the exterior of a PDP according to a second embodiment. As shown, two vent holes 31*a* and 31*b* are provided in the rear substrate 21 as extending through the rear substrate 21 and each spaced substantially the same distance from an upper edge of the rear substrate 21 in juxtaposition.

Figure 5:
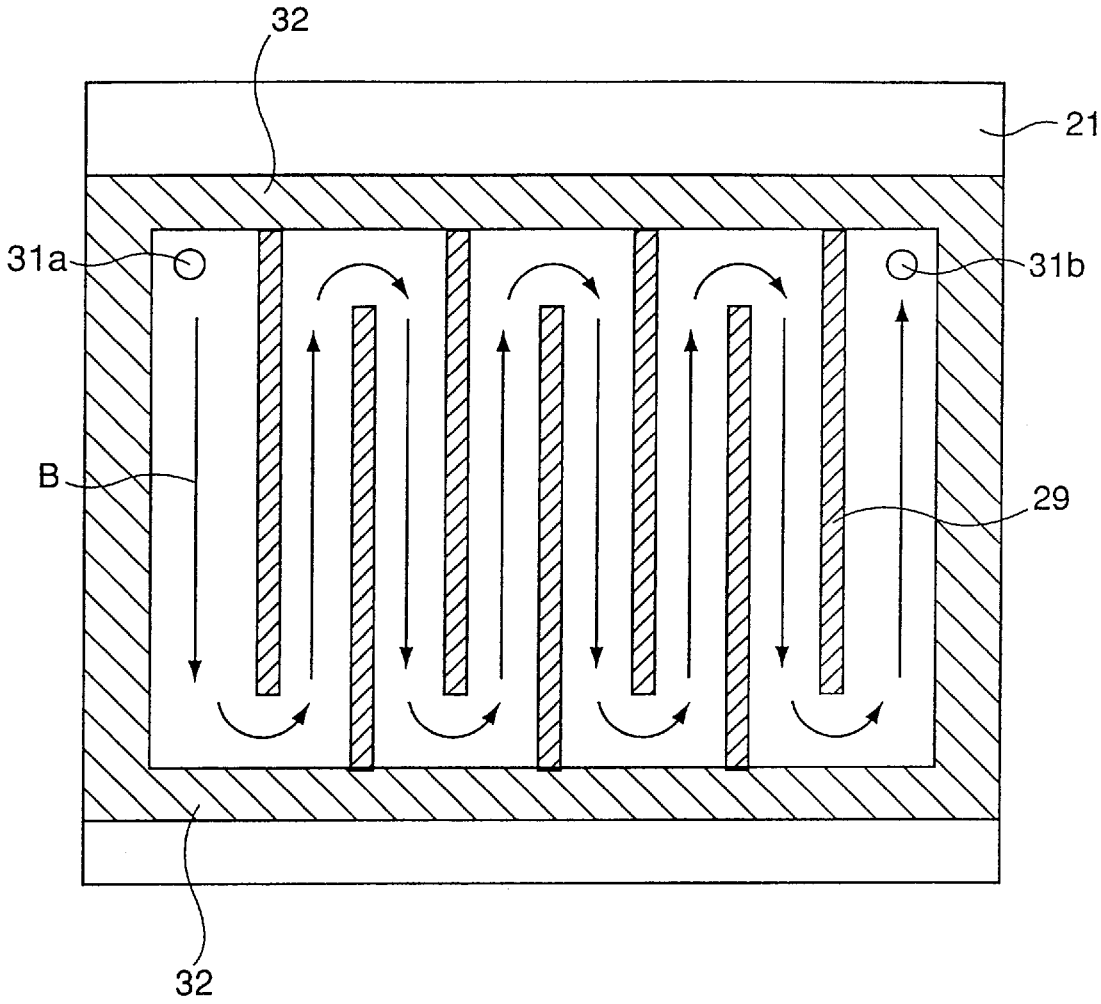
FIG. 5 is an explanatory diagram illustrating the internal construction of the PDP according to the second embodiment.

As shown in FIG. 5, linear barrier ribs are arranged parallel to each other. Since the vent holes 31*a* and 31*b* are not located in a diagonally opposite relation but in a juxtaposed relation adjacent to the upper edge of the substrate as described above, a barrier rib located adjacent to the vent hole 31*a* is provided in a different way from the first embodiment. More specifically, one end of a barrier rib 29 located leftmost as seen in FIG. 5 is extended toward one of opposed interior surfaces of the sealing member 32 adjacent to an upper left vent hole 31*a*. Similarly to the first embodiment, one end of a barrier rib adjacent to the leftmost barrier rib is extended toward the other interior surface of the sealing member. Each adjacent pair of barrier ribs are arranged in this manner, so that the barrier ribs are arranged in a staggered manner. The number of the barrier ribs is properly selected so that one end of a barrier rib 29 located rightmost as seen in FIG. 5 is extended toward the one interior surface of the sealing member adjacent to the upper right vent hole 31*b*. The extended ends of the barrier ribs 29 may abut against the corresponding interior surfaces of the sealing member 32 like in the first embodiment.

The barrier ribs each have a linear configuration in this embodiment, but may be of a waved configuration in plan.

The rear substrate 21 having such a construction is combined with the front substrate 11, and glass vent pipes are fitted to the vent holes 31*a* and 31*b*.

Third Embodiment

A PDP according to the third embodiment has two vent holes 31*a* and 31*b* provided in a diagonally opposite relation as in the first embodiment.

Figure 6:
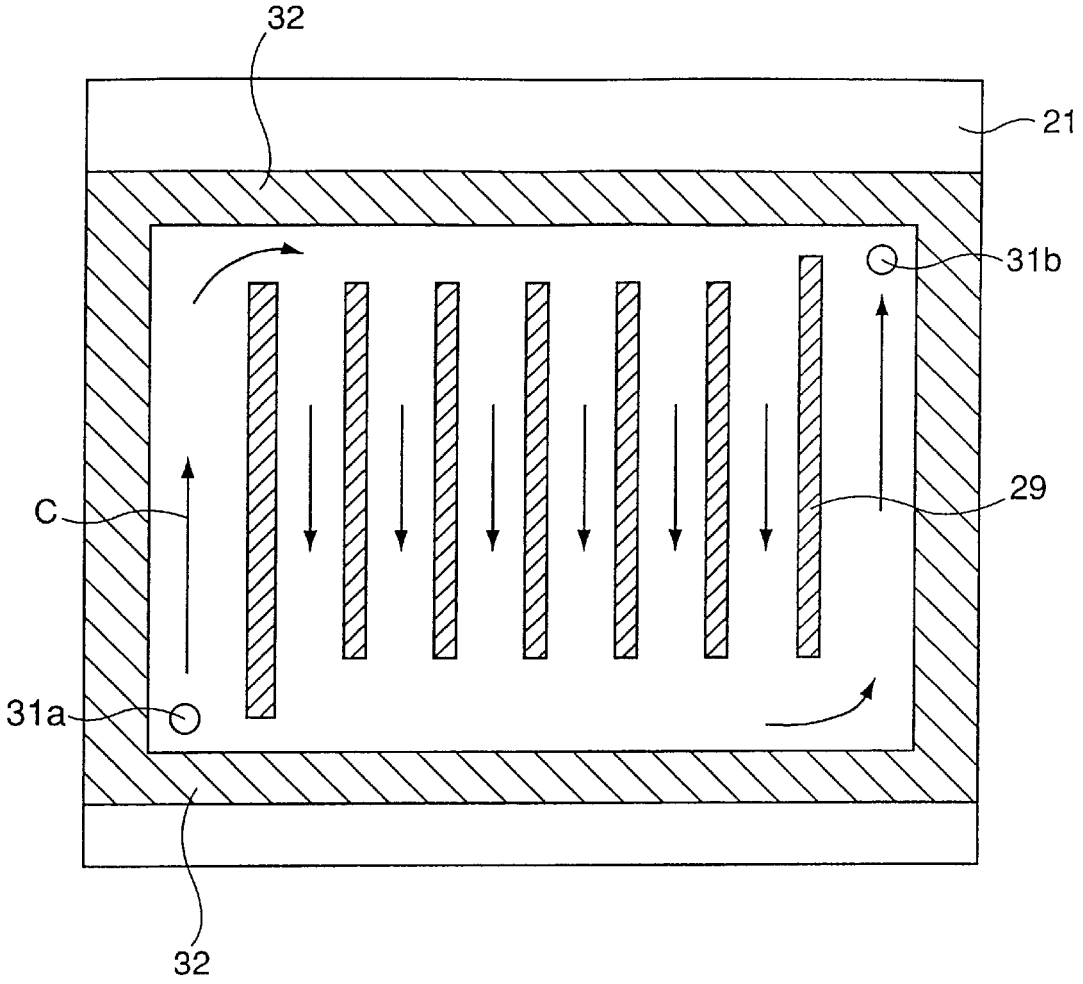
FIG. 6 is an explanatory diagram illustrating the internal construction of a PDP according to a third embodiment of the present invention.

As shown in FIG. 6, linear barrier ribs are arranged parallel to each other. More specifically, one end of a barrier rib located on one side of the barrier rib arrangement is extended toward one of opposed interior surfaces of the sealing member 32 adjacent to the vent hole 31*a*, and one end of a barrier rib located on the other side of the barrier rib arrangement is extended toward the other interior surfaces of the sealing member 32 adjacent to the vent hole 3*b*. The other barrier ribs are arranged in the conventional manner. The extended ends of the barrier ribs 29 on the opposite sides of the barrier rib arrangement may abut against the corresponding interior surfaces of the sealing member 32 as in the first and second embodiments.

In this embodiment, the barrier ribs located on the opposite sides of the barrier rib arrangement are simply elongated. This embodiment requires a smaller modification to the conventional arrangement of the barrier ribs than the first and second embodiments, and the number of the barrier ribs is not critical.

Therefore, formation of the barrier rib arrangement is easy.

The barrier ribs each have a linear configuration in this embodiment, but may be of a waved configuration in plan.

The rear substrate 21 having such a construction is combined with the front substrate 11, and glass vent pipes are fitted to the vent holes 31*a* and 31*b*.

Fourth Embodiment

Figure 7:
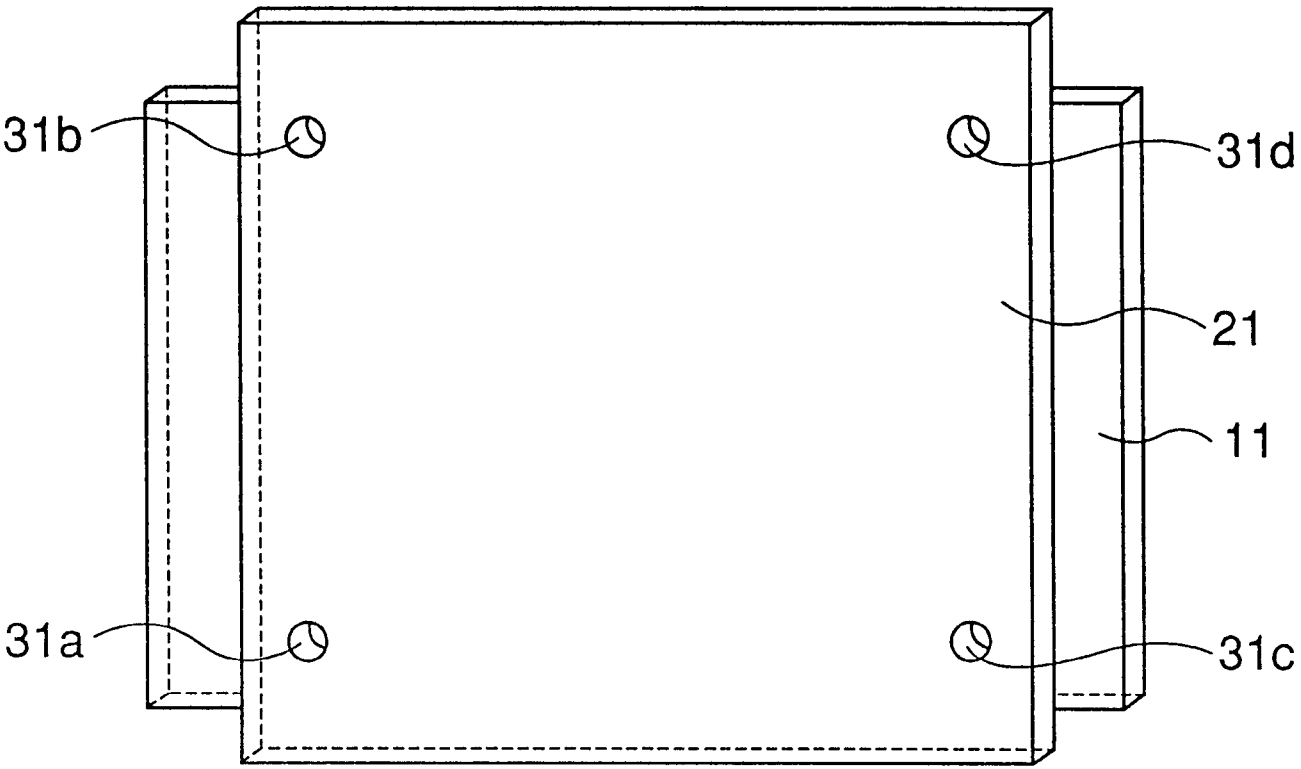
FIG. 7 is a perspective view illustrating the exterior of a PDP according to a fourth embodiment of the present invention.

FIG. 7 is a perspective view illustrating the exterior of a PDP according to a fourth embodiment. In the PDP of this embodiment shown in FIG. 7, four vent holes 31*a*, 31*b*, 31*c* and 31*d* are provided in four corners of the rear substrate 21. Out of the four vent holes 31*a*, 31*b*, 31*c* and 31*d*, two vent holes 31*b* and 31*d* located on the upper side and the other two vent holes 31*a* and 31*c* located on the lower side may serve as gas inlets and gas outlets, respectively. Conversely, the upper vent holes and the lower vent holes may serve as the gas outlets and the gas inlets, respectively.

Figure 8:
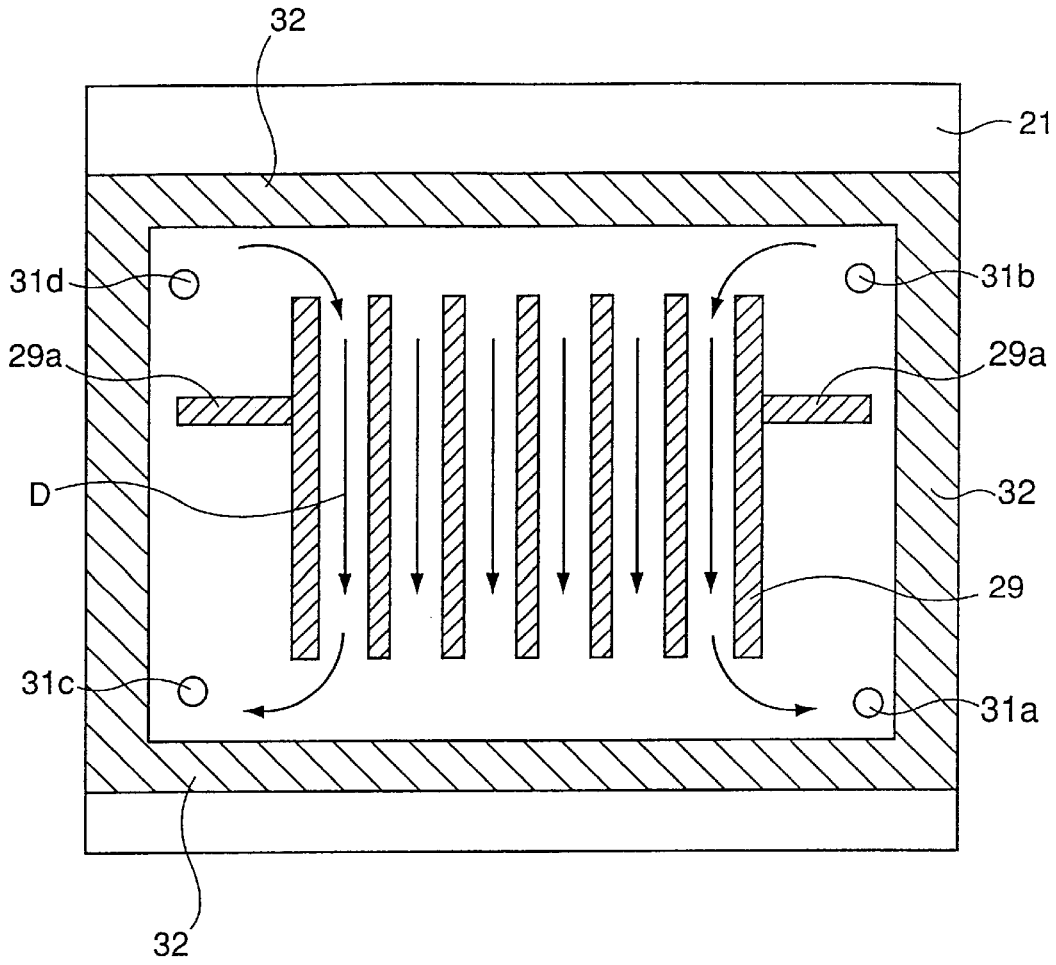
FIG. 8 is an explanatory diagram illustrating the internal construction of the PDP according to the fourth embodiment.

Linear barrier ribs 29 are arranged parallel to each other as shown in FIG. 8, and gas flow barrier ribs 29*a* are provided as gas flow barriers. More specifically, the gas flow barrier ribs 29*a* separating the upper vent holes from the lower vent holes respectively extend toward opposed interior surfaces of a sealing member 32 from side walls of barrier ribs located on opposite sides of the barrier rib arrangement.

The gas flow barrier ribs 29*a* are not necessarily required to be located symmetrically with each other, but may extend from any positions on the side walls of the barrier ribs 29 located on the opposite side of the barrier rib arrangement. A spacing between the gas flow barrier rib 29*a* and the interior surface of the sealing member 32 is preferably smaller than an inter-rib spacing, so that the gas flow conductance of a gap between the gas flow barrier rib 29*a* and the interior surface of the sealing member 32 is smaller than the gas flow conductance of the inter-rib space.

The gas flow barrier ribs 29*a* may abut against the interior surfaces of the sealing member 32. The barrier ribs 29 and the gas flow barrier ribs 29*a* each have a linear configuration in this embodiment, but may be of a waved configuration in plan.

The rear substrate 21 having such a construction is combined with the front substrate 11, and glass vent pipes are fitted to the vent holes 31*a*, 31*b*, 31*c* and 3*d*. In this embodiment, the assembly process may be complicated by the provision of the four vent pipes in comparison with the case where two vent holes are provided. However, a gas can be introduced from the two lower vent holes 31*a* and 31*c* and expelled from the two upper vent holes 31*b* and 31*d* (or vice versa), so that the number of the gas flow paths for the evacuation and gas introduction can be doubled. Therefore, the time required for the evacuation and gas introduction process can be shortened.

Fifth Embodiment

Figure 9:
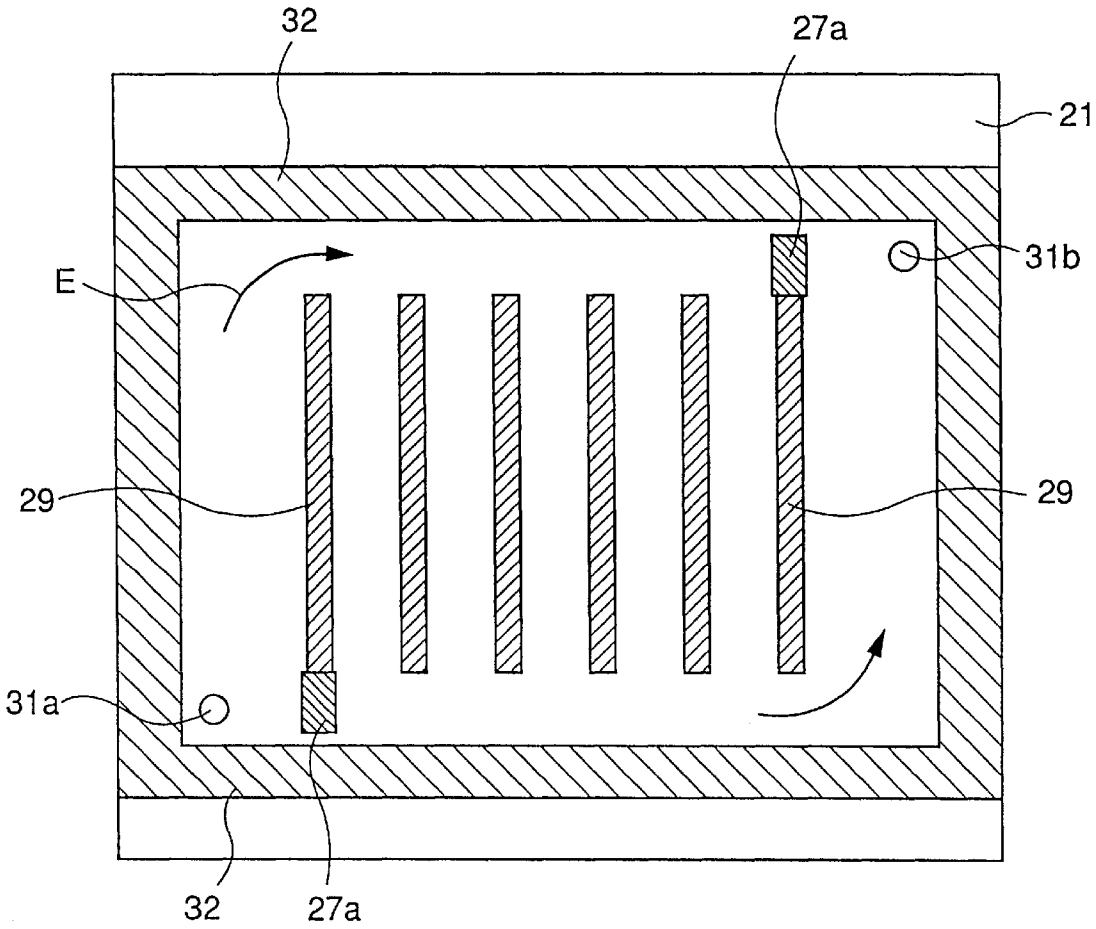
FIG. 9 is an explanatory diagram illustrating the internal construction of a PDP according to a fifth embodiment.

FIG. 9 is a diagram illustrating the internal construction of a PDP according to a fifth embodiment. The PDP has substantially the same internal construction as the PDP according to the third embodiment, except that gas flow is hindered not by gas flow barrier ribs but by gas flow barriers 27*a* formed of a material different from the barrier rib material. The gas flow barriers 27*a* are respectively provided between one end of the leftmost barrier rib 29 and one of opposed interior surfaces of the sealing member 32 and between one end of the rightmost barrier rib 29 and the other interior surface of the sealing member 32 to narrow the spaces therebetween.

Additional gas flow barriers 27*a* may be provided in a staggered manner between the respective barrier ribs and either of the opposed interior surfaces of the sealing member to form substantially the same internal construction as in the first embodiment.

Sixth Embodiment

Figure 10:
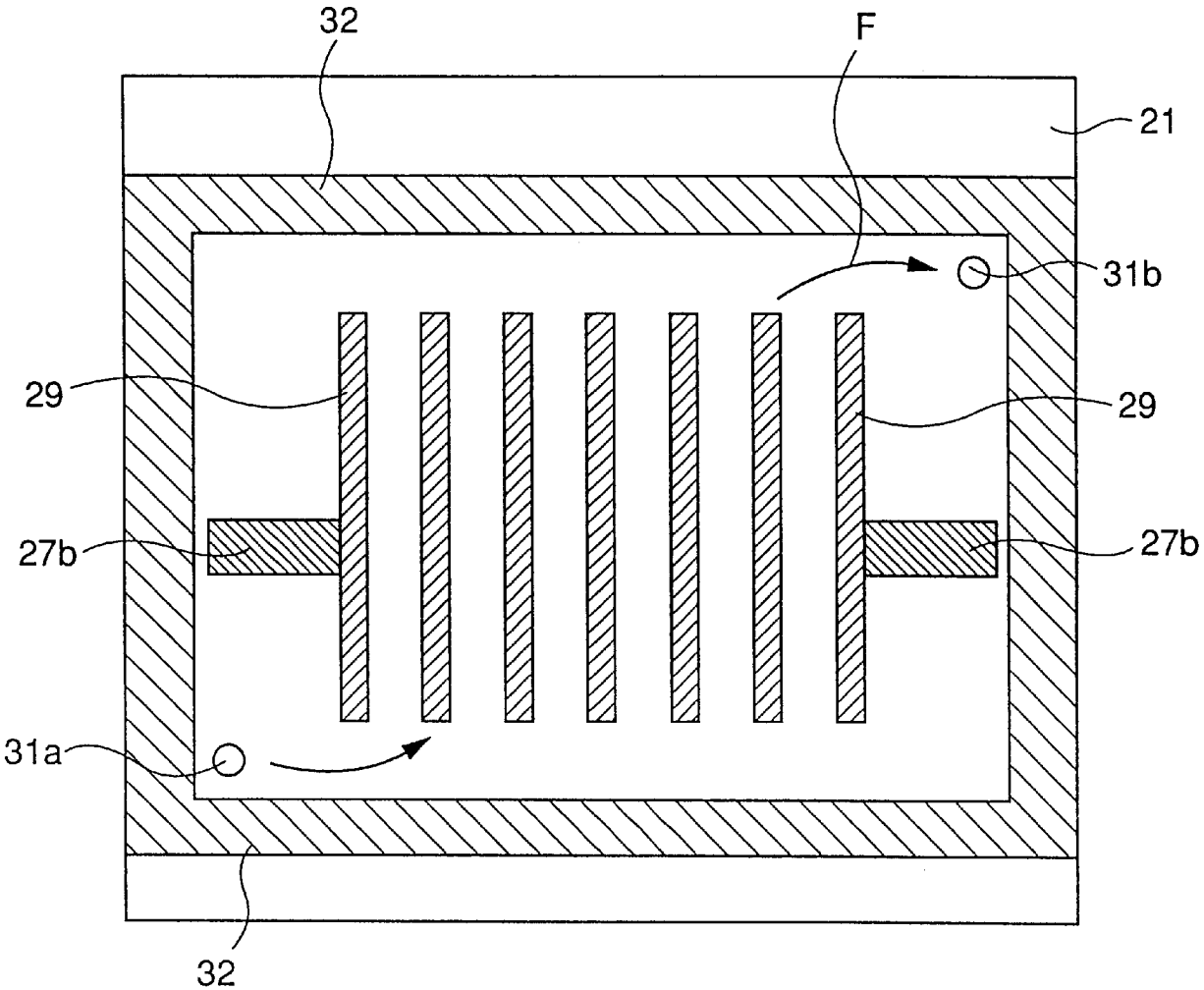
FIG. 10 is an explanatory diagram illustrating the internal construction of a PDP according to a sixth embodiment.

FIG. 10 is a diagram illustrating the internal construction of a PDP according to a sixth embodiment. The PDP has substantially the same internal construction as the PDP according to the fourth embodiment, except that two vent holes are provided and gas flow barriers 27*b* made of a material different from the barrier rib material are provided instead of the gas flow barrier ribs 29*a* to hinder the gas flow.

The gas flow barriers 27*b* may respectively project from any positions on the side walls of the leftmost and rightmost barrier ribs toward opposed interior surfaces of the sealing member.

Gas flow barriers 27*a* as described in the fifth embodiment may additionally be provided in a staggered manner between the other barrier ribs and either of the other opposed interior surfaces of the sealing member to form substantially the same internal construction as in the first embodiment.

Seventh Embodiment

Figure 11:
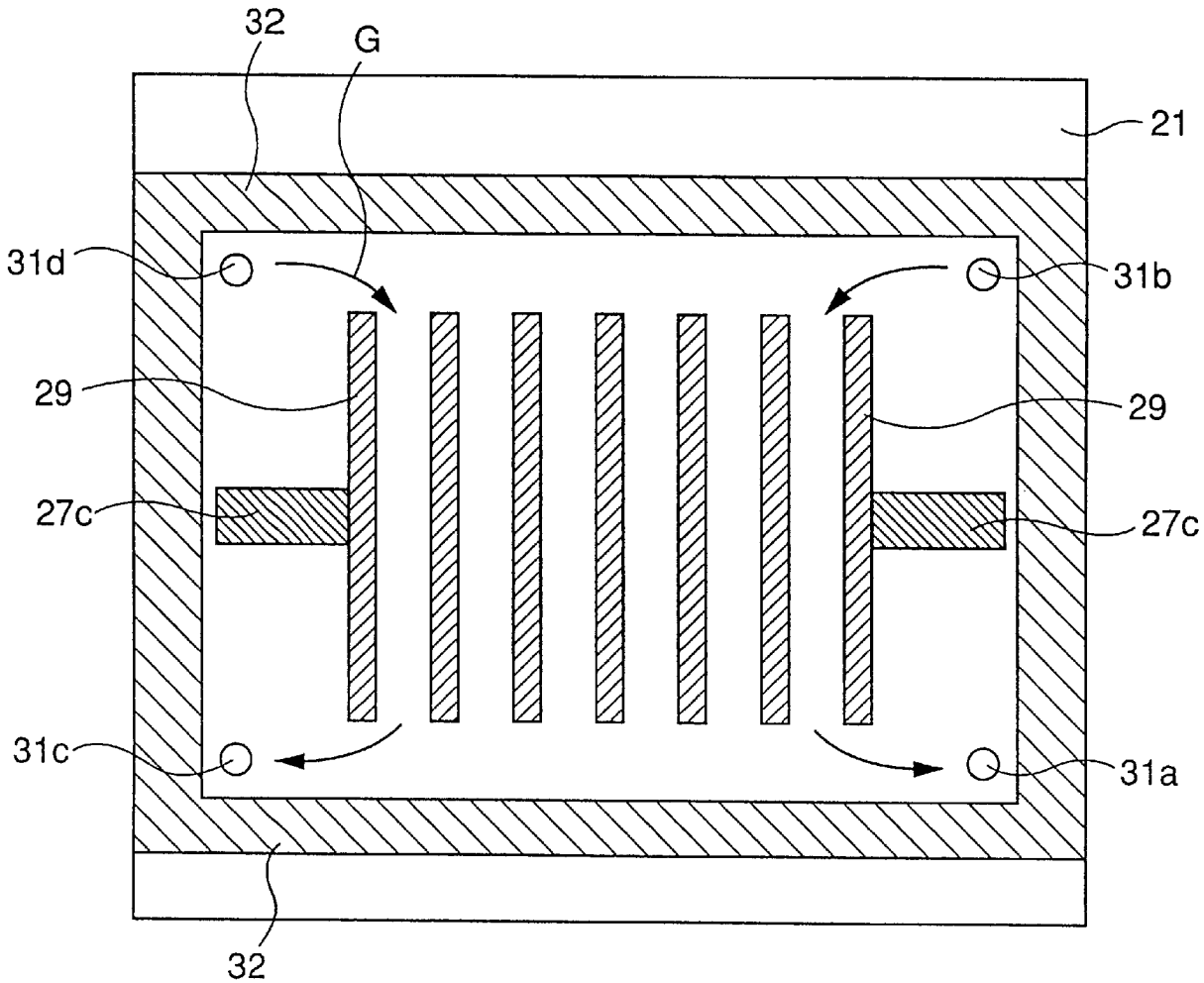
FIG. 11 is an explanatory diagram illustrating the internal construction of a PDP according to a seventh embodiment.

FIG. 11 is a diagram illustrating the internal construction of a PDP according to a seventh embodiment. The PDP has substantially the same internal construction as the PDP according to the sixth embodiment, except that the PDP has four vent holes.

The gas flow barriers 27*c* may respectively project from any positions on the side walls of the leftmost and rightmost barrier ribs toward opposed interior surfaces of the sealing member.

In the fifth to seventh embodiments, the formation of the gas flow barriers 27*a*, 27*b* or 27*c* may be carried out concurrently with the formation of the barrier ribs 29 or the formation of the sealing member 32.

Eighth Embodiment

Figure 12:
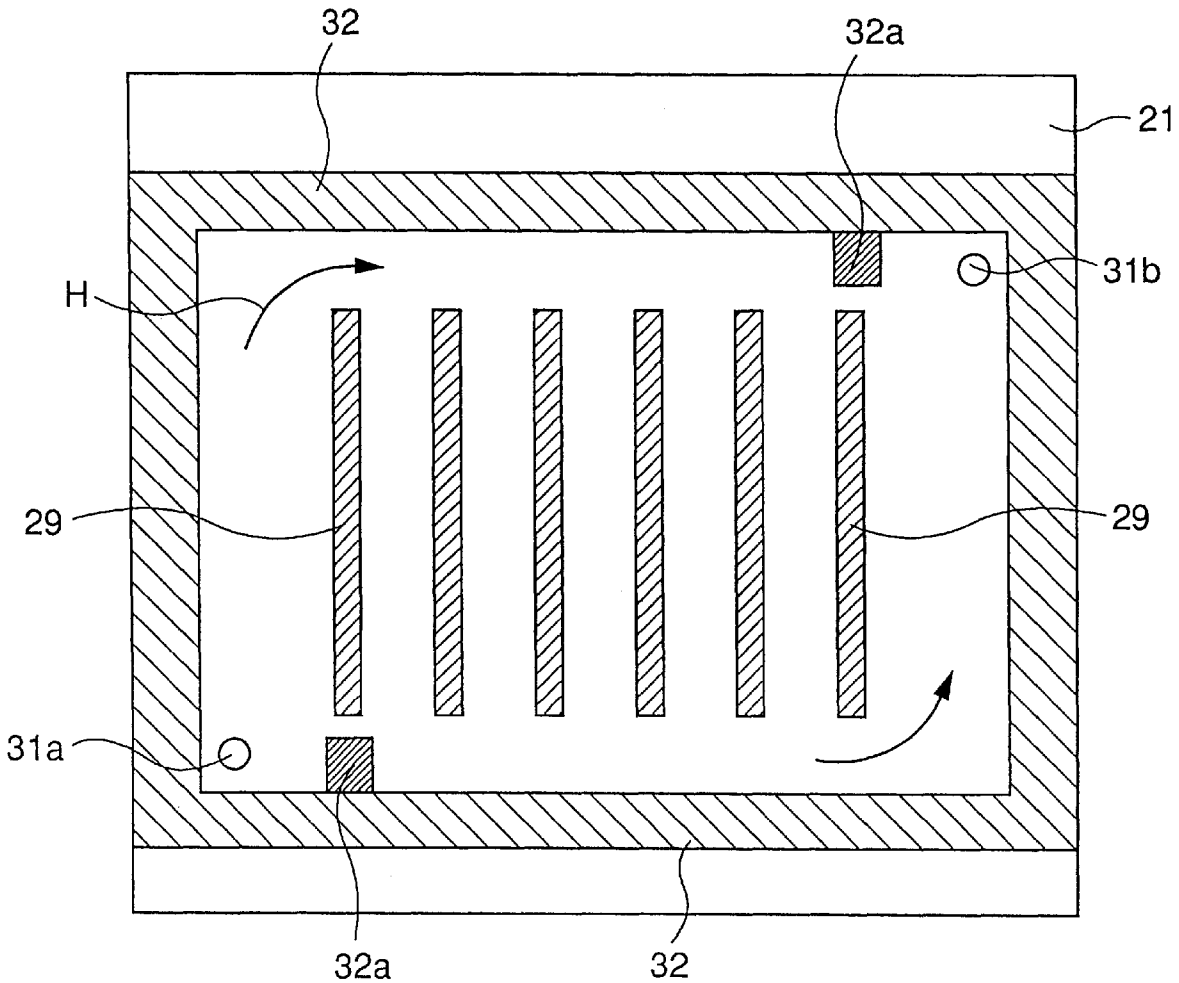
FIG. 12 is an explanatory diagram illustrating the internal construction of a PDP according to an eighth embodiment.

FIG. 12 is a diagram illustrating the internal construction of a PDP according to an eighth embodiment. The PDP has substantially the same internal construction as the PDP according to the fifth embodiment, except that gas flow barriers 32*a* are respectively provided adjacent to the vent holes as projecting from opposed interior surfaces of the sealing member 32 toward the leftmost and rightmost barrier ribs 29.

Additional gas flow barriers 32*a* may be provided in a staggered manner as projecting from either of the opposed interior surfaces of the sealing member 32 toward the respective barrier ribs to form substantially the same internal construction as in the first embodiment.

Ninth Embodiment

Figure 13:
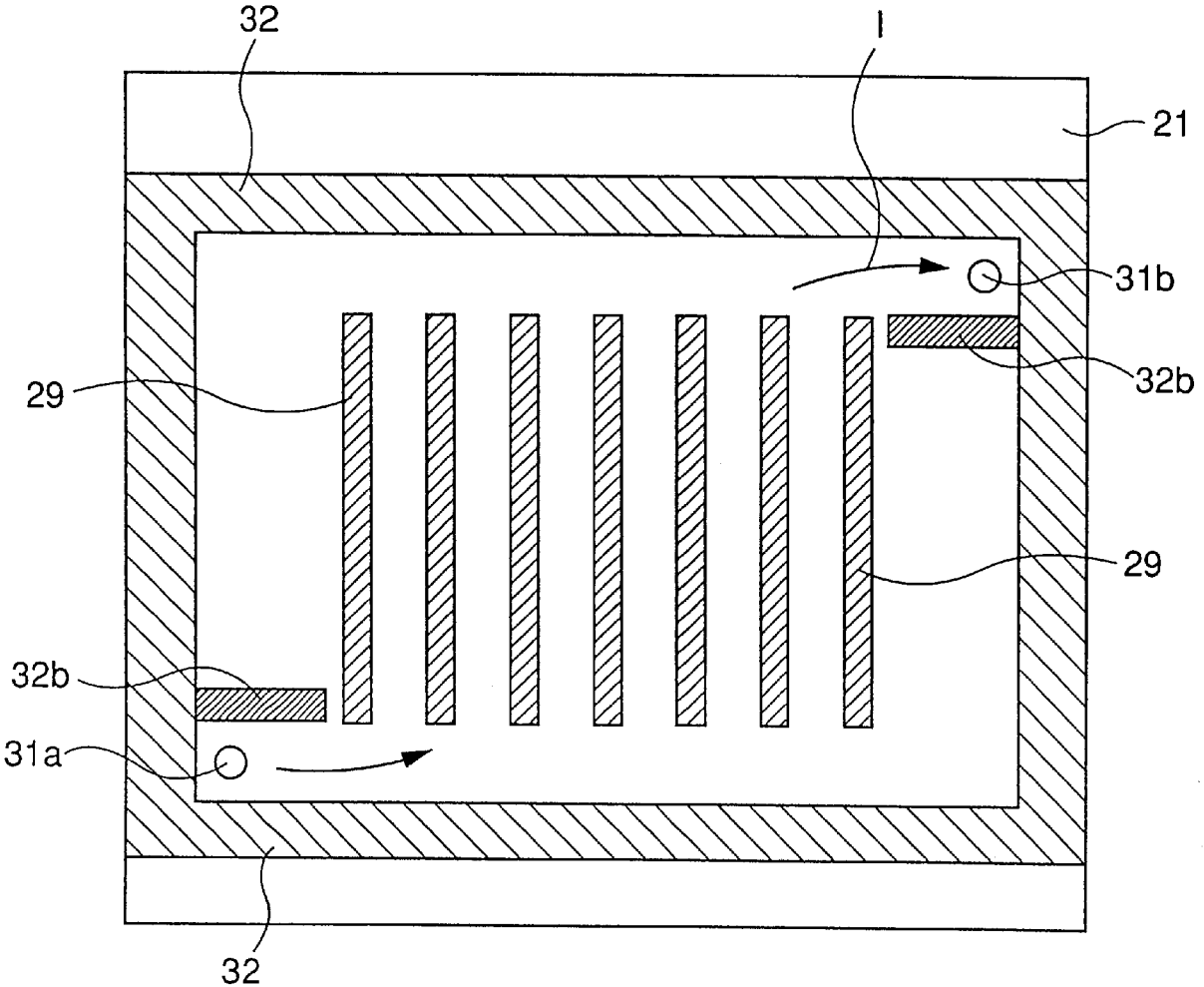
FIG. 13 is an explanatory diagram illustrating the internal construction of a PDP according to a ninth embodiment.

FIG. 13 is a diagram illustrating the internal construction of a PDP according to a ninth embodiment. The PDP has substantially the same internal construction as the PDP according to the sixth embodiment, except that gas flow barriers 32*b* respectively project from opposed interior surfaces of the sealing member 32 toward the side walls of the leftmost and rightmost barrier ribs 29 as seen in FIG. 13.

The gas flow barriers 32*b* may respectively project toward any positions on the side walls of the leftmost and rightmost barrier ribs from the opposed interior surfaces of the sealing member.

Gas flow barriers 32*a* as described in the eighth embodiment may additionally be provided in a staggered manner between the other barrier ribs and either of the other opposed interior surfaces of the sealing member to form substantially the same internal construction as in the first embodiment.

Tenth Embodiment

Figure 14:
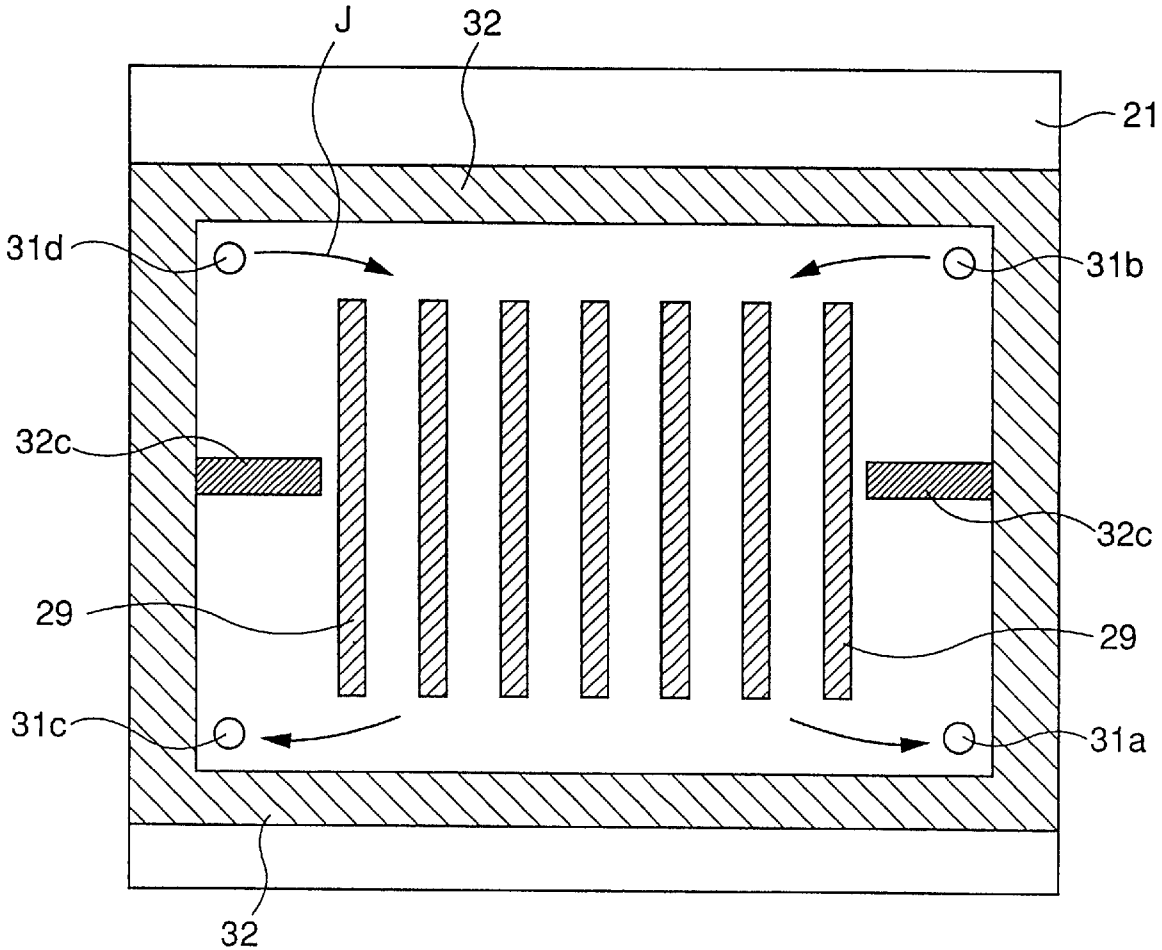
FIG. 14 is an explanatory diagram illustrating the internal construction of a PDP according to a tenth embodiment.

FIG. 14 is a diagram illustrating the internal construction of a PDP according to a tenth embodiment. The PDP has substantially the same internal construction as the PDP according to the seventh embodiment, except that gas flow barriers 32*c* respectively project from opposed interior surfaces of the sealing member 32 toward the side walls of the leftmost and rightmost barrier ribs as seen in FIG. 14.

The gas flow barriers 32*c* may respectively project toward any positions on the side walls of the leftmost and rightmost barrier ribs from the opposed interior surfaces of the sealing member.

Figure 15A:
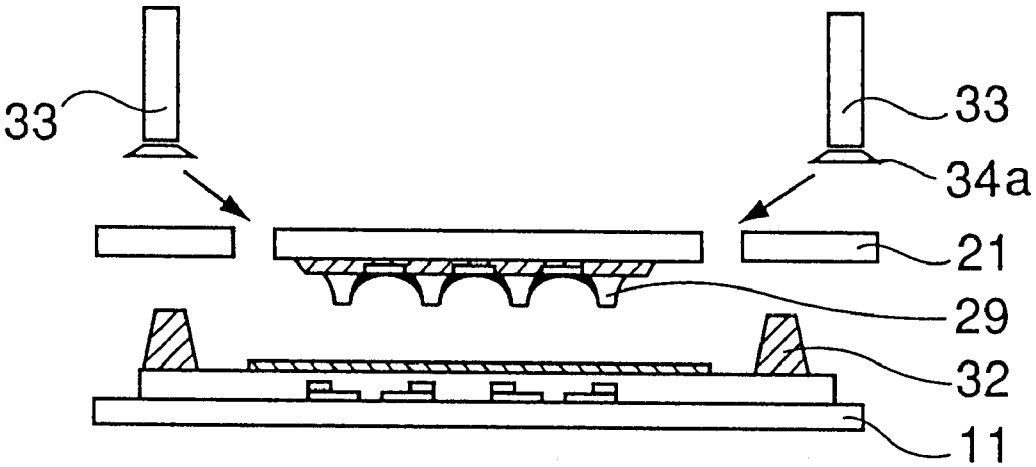
FIGS. 15A and 15B are diagrams for explaining a substrate combining and vent pipe attaching process and an evacuation and gas introduction process, respectively.

In the first to tenth embodiments, the vent pipes are fitted to the vent holes with the use of a melt-bonding glass paste 34*a* as shown in FIG. 15A, when the front substrate 11 and the rear substrate 21 are combined together by thermally melting the sealing member 32 of a low melting point glass applied on the peripheral portion of the front substrate 11.

Figure 15B:
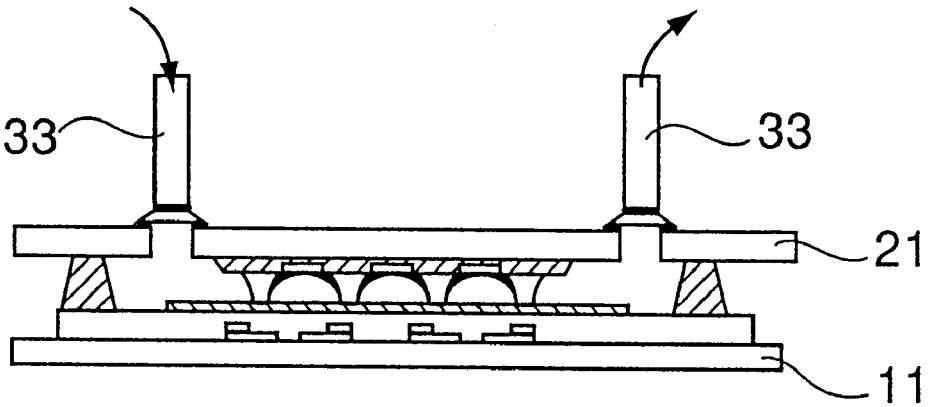

For removal of the impurity gases remaining in the panel, the impurity gases are forcibly expelled by way of gas replacement by introducing the cleaning gas into the panel as shown in FIG. 15B. More specifically, the discharge gas is introduced from one of the vent holes 33, while the panel is evacuated from the other vent hole 33. When the internal pressure of the panel reaches a desired level, the vent pipes 33 are sealed. Thus, the PDP is completed.

Figure 16A:
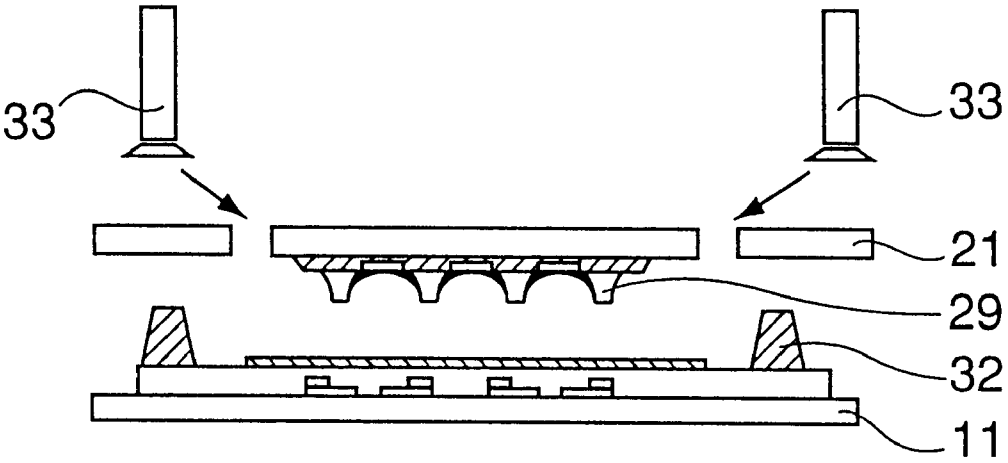
FIGS. 16A and 16B are diagrams for explaining a case where an impurity gas absorbent is provided in the vent pipes.
Figure 16B:
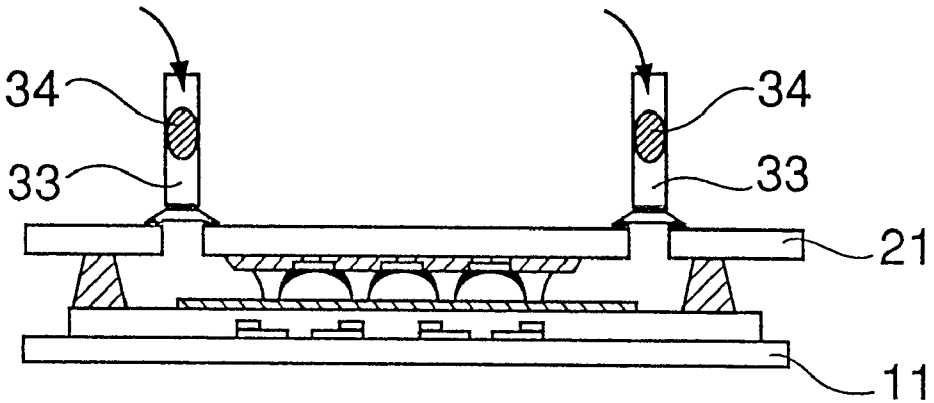

FIGS. 16A and 16B are diagrams for explaining a case where an impurity gas absorbent is provided in the vent pipes for absorbing (or adsorbing) the impurity gases.

As shown, the impurity gas absorbent may be provided in the vent pipes 33 of any of the PDPs according to the first to tenth embodiments.

When the front substrate 11 and the rear substrate 21 are combined together by melting the sealing member 32 and the vent pipes are fitted to the vent holes as shown in FIG. 16A, the impurity gas absorbent 34, e.g., a getter, is inserted into at least one of the vent pipes 33 and fixed therein as shown in FIG. 16B. The impurity gas absorbent may be fitted in some or all of the vent pipes 33. Further, only the vent pipes 33 containing the impurity gas absorbent 34 may thereafter be sealed.

There will next be explained exemplary evacuation and gas introduction processes to be applied to the PDPs having the aforesaid constructions and exemplary apparatuses employed for these processes. In the following explanation, there are shown first to sixth evacuation and gas introduction processes.

First Evacuation and Gas Introduction Process

Figure 17:
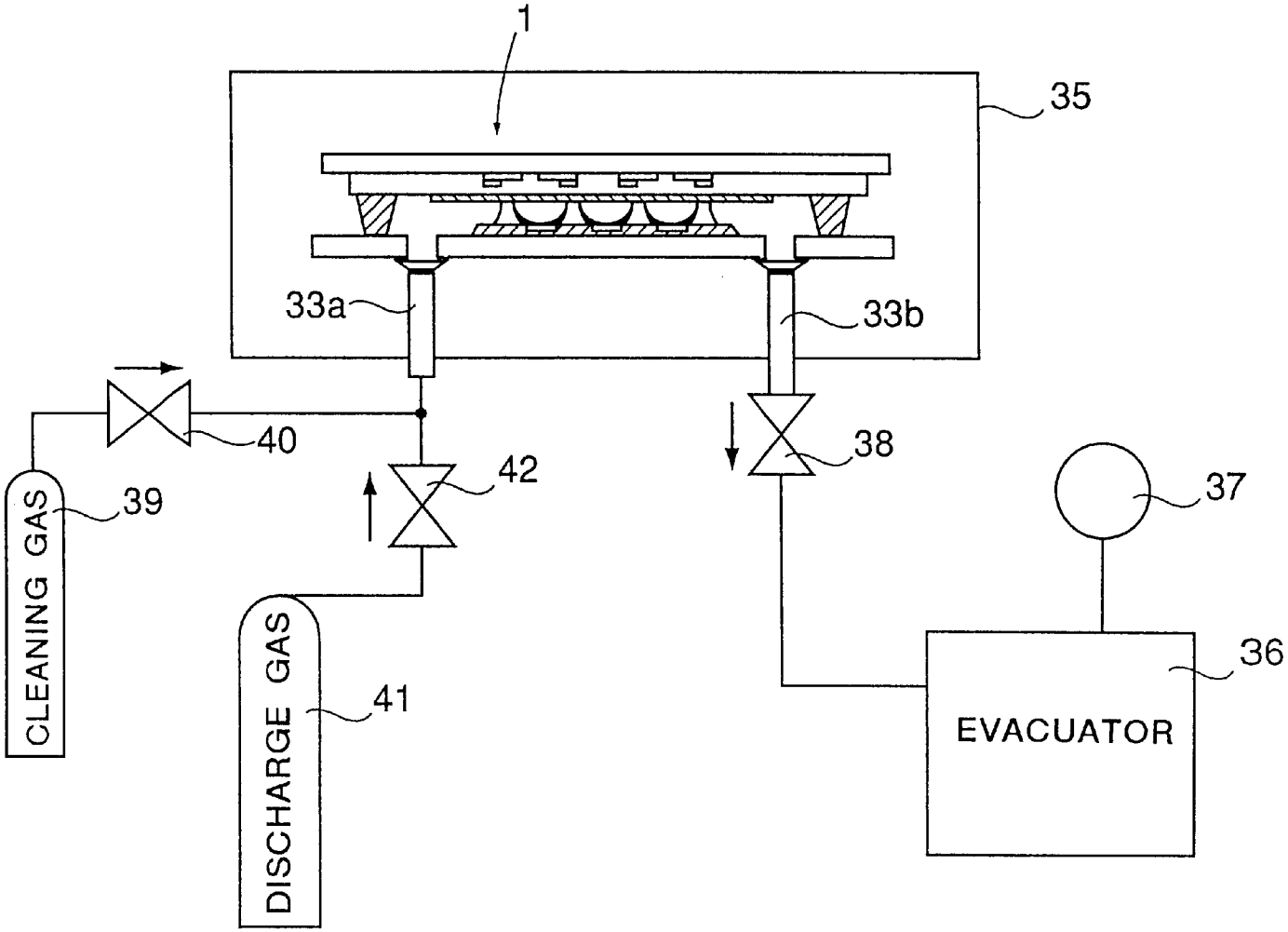
FIG. 17 is a diagram illustrating an evacuation and gas introduction apparatus to be used for a first evacuation and gas introduction process according to the present invention.

In this process, an apparatus as shown in FIG. 17 is employed for the evacuation and gas introduction for a PDP 1. In FIG. 17, there are shown an oven 35 for heating the PDP 1 before the sealing of the vent pipes, an evacuator 36, a vacuum indicator 37 for indicating the degree of vacuum of the evacuator 36, an evacuation valve 38, a cleaning gas cylinder 39, a cleaning gas inlet valve 40, a discharge gas cylinder 41 and a discharge gas inlet valve 42. Out of the vent pipes attached to the PDP 1, a gas inlet pipe and a gas outlet pipe are herein denoted by reference characters 33*a* and 33*b*, respectively.

First, the PDP 1 is placed in the oven 35. Any of the PDPs according to the first to tenth embodiments and the PDPs provided with the impurity gas absorbent may be used as the PDP 1. The gas outlet pipe 33*b* of the PDP 1 is connected to the evacuation valve 38 which is further connected to the evacuator 36, and the gas inlet pipe 33*a* is connected to the cleaning gas inlet valve 40 and the discharge gas inlet valve 42 which are further connected to the cleaning gas cylinder 39 and the discharge gas cylinder 41, respectively.

Where the PDP according to the fourth, seventh or tenth embodiment is employed, two gas outlet pipes and two gas inlet pipes are connected to the respective vent holes.

Usable as the cleaning gas are any gases which do not adversely influence the panel characteristics when used for the removal of the impurity gases. Plural kinds of gases may be used as the cleaning gas. Examples of the cleaning gas include $N_2$, Ne, He, Ar and gas mixtures thereof. The discharge gas may be used as the cleaning gas. In such a case, a single gas cylinder and a single gas valve for the discharge gas are provided in the apparatus.

Figure 18:
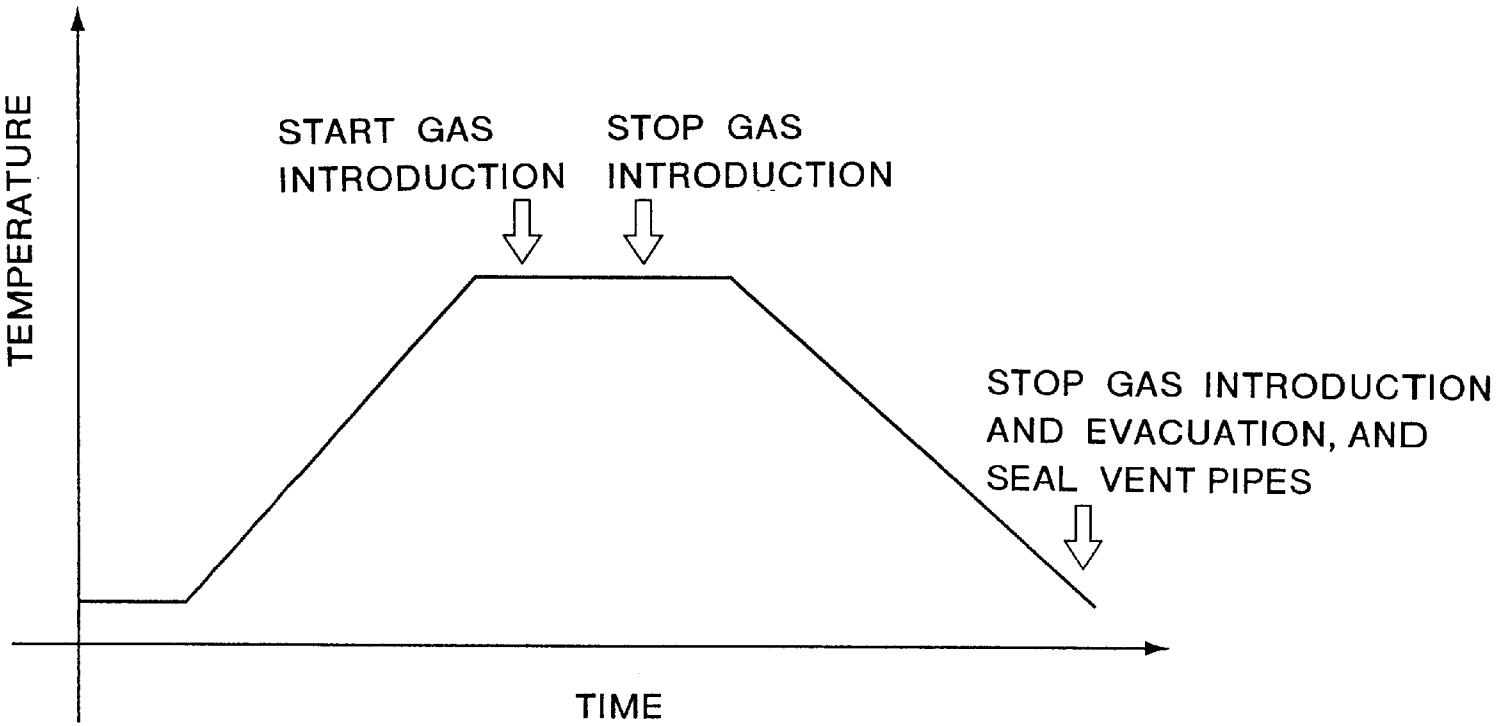
FIG. 18 is a graphical representation illustrating a panel temperature profile for the first evacuation and gas introduction process.

The evacuation process is performed in the following manner. As described above, the PDP 1 is first placed in the oven 35 for controlling the temperature of the PDP 1. Then, the evacuation valve 38 is opened with the cleaning gas inlet valve 40 and the discharge gas inlet valve 42 closed, and the PDP 1 is evacuated by the evacuator 36. During the evacuation process, the temperature of the PDP 1 is controlled in the oven 35 in accordance with a panel temperature profile shown in FIG. 18.

More specifically, the PDP 1 is heated up to a predetermined temperature at which the impurity gases adsorbed on the barrier ribs and the like in the PDP 1 can be released therefrom. Thereafter, the PDP 1 is kept at the predetermined temperature to cause the impurity gases to be released from the barrier ribs and the like in the PDP 1.

In the gas introduction process, the cleaning gas is continuously introduced into the PDP 1 with the cleaning gas inlet valve 40 opened. In the midst of the gas introduction process, the kind of the gas to be introduced into the PDP 1 may be changed. For example, $N_2$ gas may be introduced into the PDP 1 instead of Ne gas in the midst of the gas introduction.

When the cleaning gas is thus introduced into the PDP 1, the cleaning gas flows as indicated by arrows A in FIG. 3 in the case of the PDP according to the first embodiment, by arrows B in FIG. 5 in the case of the PDP according to the second embodiment, by arrows C in FIG. 6 in the case of the PDP according to the third embodiment, by arrows D in FIG. 8 in the case of the PDP according to the fourth embodiment, by arrows E in FIG. 9 in the case of the PDP according to the fifth embodiment, by arrows F in FIG. 10 in the case of the PDP according to the sixth embodiment, by arrows G in FIG. 11 in the case of the PDP according to the seventh embodiment, by arrows H in FIG. 12 in the case of the PDP according to the eighth embodiment, by arrows I in FIG. 13 in the case of the PDP according to the ninth embodiment, and by arrows J in FIG. 14 in the case of the PDP according to the tenth embodiment.

The cleaning gas thus flows through the inter-rib spaces, and the impurity gases emanating from the barrier ribs and the like are forcibly expelled from the gas outlet pipe 33*b*.

Where the impurity gas absorbent is provided in the gas inlet and outlet pipes 33*a* and 33*b* as shown in FIG. 16B, the cleaning gas is purified by the impurity gas absorbent in the gas inlet pipe 33*a* and the impurity gases are absorbed by the impurity gas absorbent in the gas outlet pipe 33*b*.

In turn, the cleaning gas inlet valve 40 is closed to stop the gas introduction, and the oven 35 is controlled to cool the PDP 1 to room temperature. After the temperature of the PDP 1 reaches room temperature, the evacuation valve 38 is closed, and the discharge gas is introduced into the PDP 1 with the discharge gas inlet valve 42 opened. Then, the vent pipes 33*a* and 33*b* are sealed.

Second Evacuation and Gas Introduction Process

Figure 19:
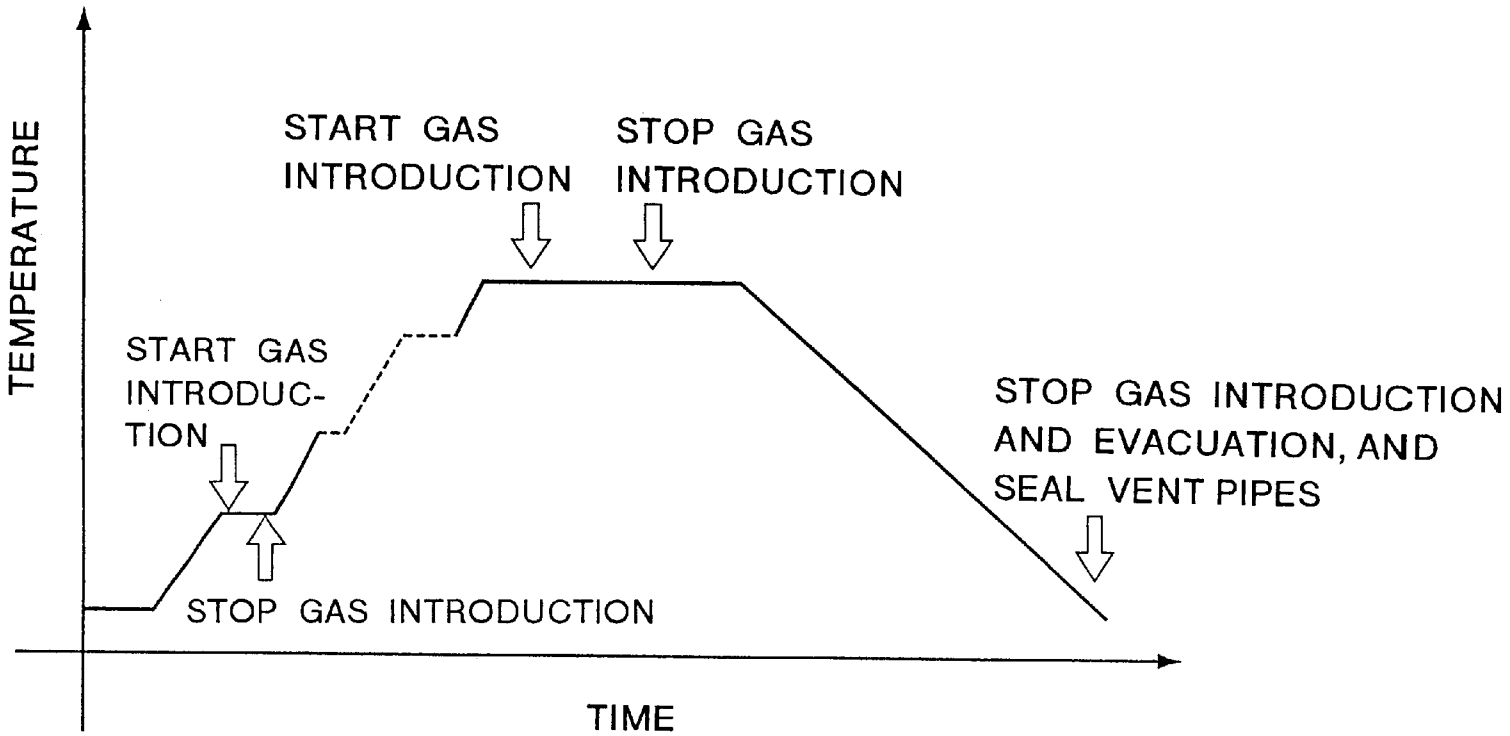
FIG. 19 is a graphical representation illustrating a panel temperature profile for a second evacuation and gas introduction process according to the present invention.

This process employs the same apparatus as the first evacuation and gas introduction process. This process can be applied to any of the PDPs according to the first to tenth embodiments and the PDPs provided with the impurity gas absorbent. A PDP 1 is first placed in the oven 35. In this process, the temperature of the PDP 1 is controlled in the oven 35 in accordance with a panel temperature profile as shown in FIG. 19, unlike in the first evacuation and gas introduction process.

More specifically, the cleaning gas inlet valve 40 is repeatedly opened and closed for starting and stopping the introduction of the cleaning gas at particular temperatures before the temperature of the PDP 1 reaches a predetermined impurity gas releasable temperature. The cleaning gas to be used is the same as that used in the first evacuation and gas introduction process.

When the temperature of the PDP 1 reaches a particular temperature, the cleaning gas is introduced into the PDP 1 with the PDP 1 being kept at the particular temperature. Thereafter, the PDP 1 is evacuated with the cleaning gas inlet valve 40 closed. This operation is repeated several times until the temperature of the PDP 1 reaches the predetermined impurity gas releasable temperature.

Although this operation requires time and labor before the temperature of the PDP 1 reaches the predetermined impurity gas releasable temperature, gases (e.g., $H_2O$ gas) which have release peaks at these particular temperatures can assuredly be expelled. An operation to be performed after the temperature of the PDP 1 reaches the impurity gas releasable temperature is the same as in the first evacuation and gas introduction process.

Third Evacuation and Gas Introduction Process

Figure 20:
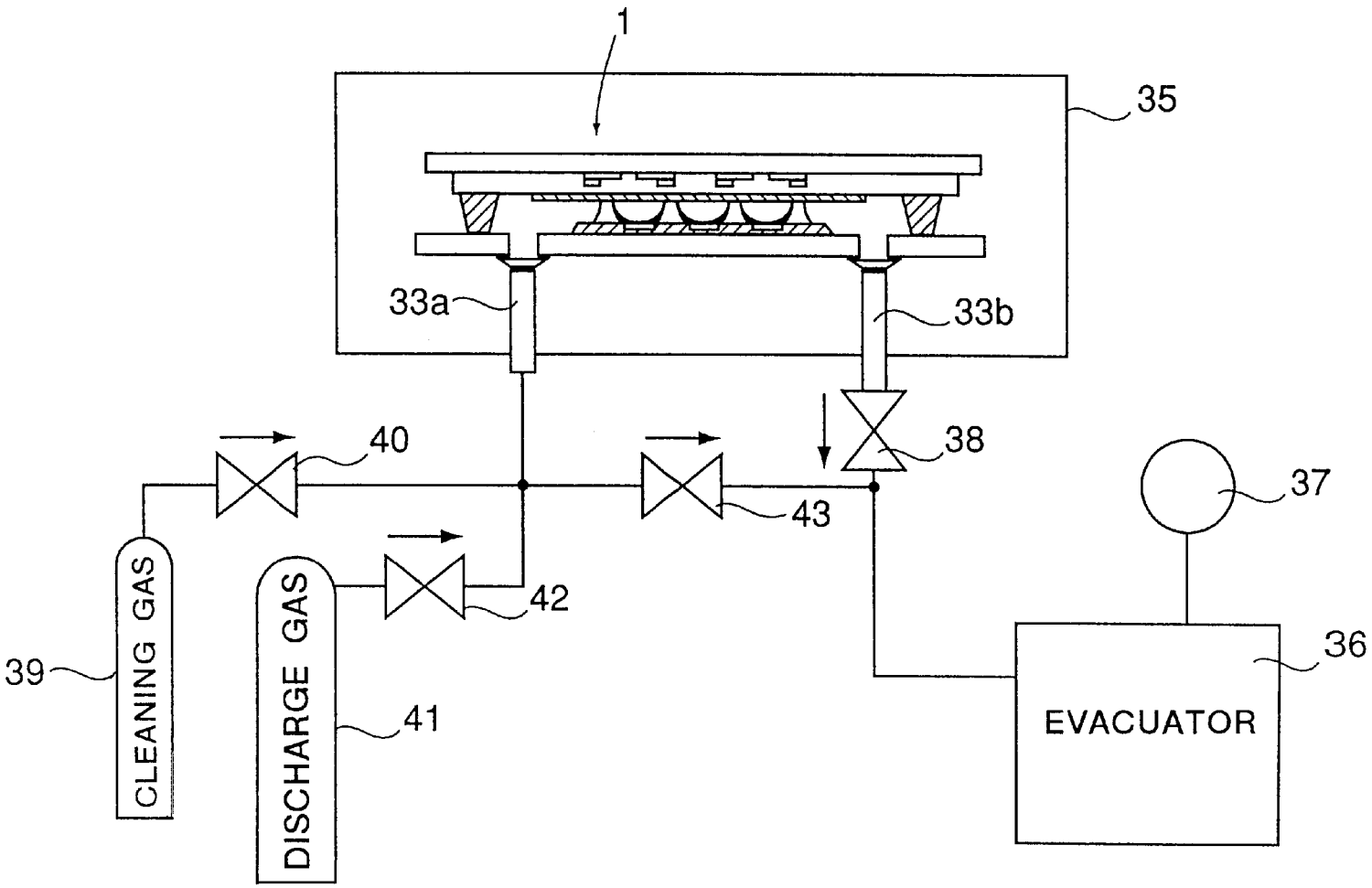
FIG. 20 is a graphical representation illustrating a panel temperature profile for a third evacuation and gas introduction process according to the present invention.

In this process, an apparatus as shown in FIG. 20 is used for the evacuation and gas introduction for a PDP 1. The apparatus has substantially the same construction as the apparatus shown in FIG. 17, except that the gas inlet pipe 33*a* and the gas outlet pipe 33*b* are connected to each other via an evacuation valve 43 provided therebetween. Thus, the vent pipe 33*a* which serves as the gas inlet pipe can also be used for the evacuation.

The PDP 1 is placed in the oven 35. Any of the PDPs according to the first to tenth embodiments and the PDPs provided with the impurity gas absorbent 34 may be used as the PDP 1. In this process, the panel temperature control for the evacuation and gas introduction process may be performed in the same manner as in the first or second evacuation and gas introduction process.

In the evacuation process, the PDP 1 is evacuated by the evacuator 36 with the cleaning gas inlet valve 40 and the discharge gas inlet valve 42 closed and with the evacuation valves 38 and 43 opened.

In the gas introduction process, the cleaning gas is introduced into the PDP 1 with the evacuation valve 43 closed and with the cleaning gas inlet valve 40 opened. Thereafter, the PDP 1 is evacuated with the cleaning gas inlet valve 40 closed and with the evacuation valve 43 opened.

With the evacuation valves 38 and 43 closed, the discharge gas is introduced into the PDP 1 until the internal pressure of the PDP 1 reaches a desired level, and the vent pipes 33*a* and 33*b* are sealed. The subsequent operation is performed in the same manner as in the first or second evacuation and gas introduction process.

The apparatus used in this process has a complicated piping system, but the time required for the evacuation can be shortened because the PDP 1 is evacuated from the vent pipes 33*a* and 33*b*.

Fourth Evacuation and Gas Introduction Process

Figure 21:
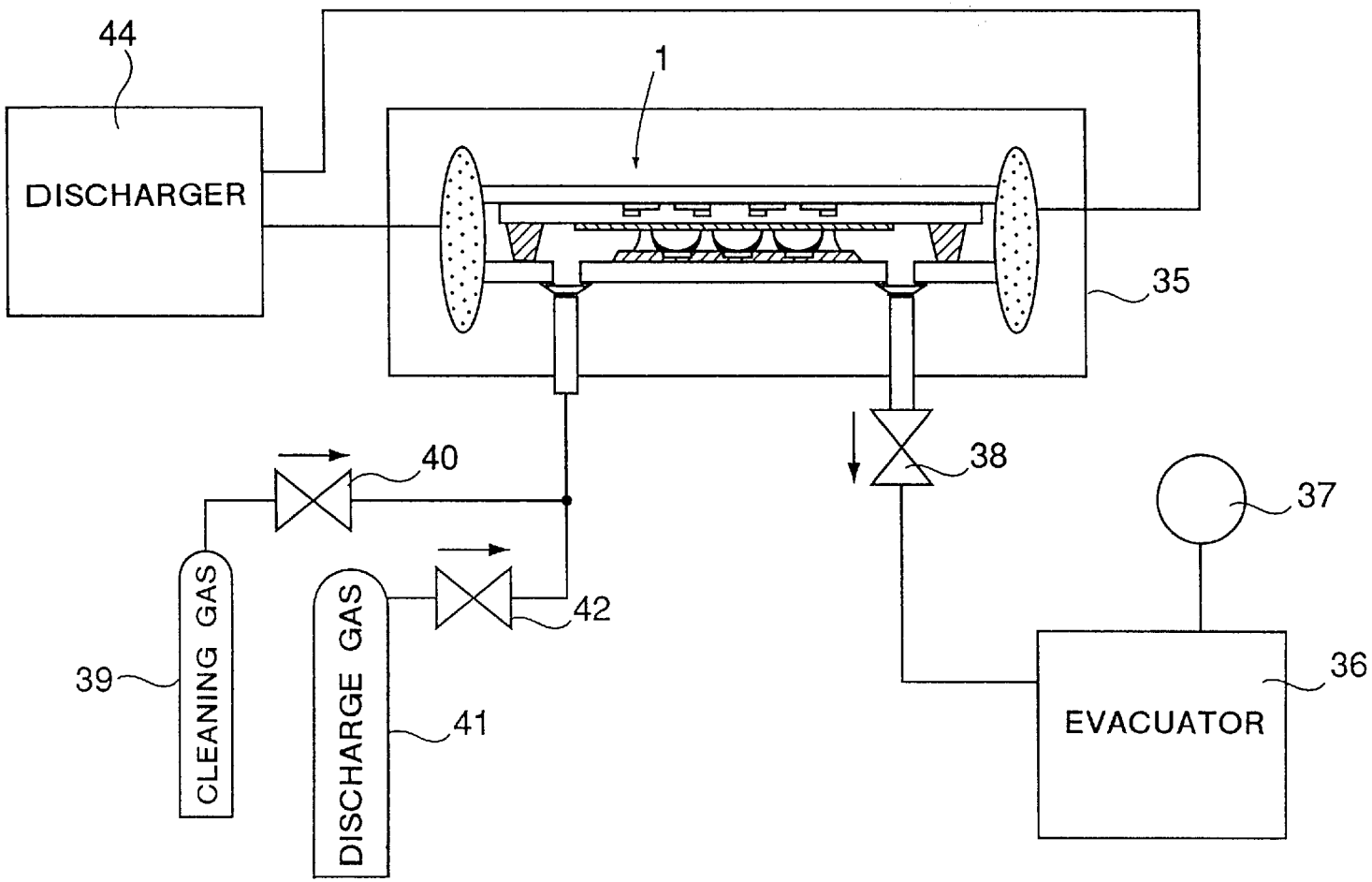
FIG. 21 is a diagram illustrating an evacuation and gas introduction apparatus to be used for fourth and fifth evacuation and gas introduction processes according to the present invention.

In this process, an apparatus as shown in FIG. 21 is used for the evacuation and the gas introduction for a PDP 1. The apparatus has substantially the same construction as the apparatus shown in FIG. 17, except that a discharger 44 for applying a voltage having a given waveform to the electrodes of the PDP 1 is provided for causing electric discharge within the PDP 1. The electrodes of the PDP 1 are interconnected with the discharger 44. The piping for the evacuation and gas introduction is the same as in the first and second evacuation and gas introduction processes.

The PDP 1 is place in the oven 35. Any of the PDPs according to the first to tenth embodiments and the PDPs provided with the impurity gas absorbent 34 may be used as the PDP 1. The panel temperature control for the evacuation and gas introduction process is performed in the same manner as in the first evacuation and gas introduction process.

The evacuation and the gas introduction process is performed in substantially the same manner as in the first evacuation and gas introduction process, except that electric discharge is caused in the PDP 1 by actuating the discharger 44 when the cleaning gas is introduced into the PDP 1 after the temperature of the PDP 1 reaches the predetermined impurity gas releasable temperature.

The electric discharge cause the impurity gases adsorbed on the surface of the protective layer and the like to be readily released therefrom. The electric discharge may be caused between the sustain electrodes X and Y, between the sustain electrodes Y and the address electrodes A, or between cleaning electrodes which will be described later. The waveform of the voltage to be applied to the electrodes is properly selected. After the completion of the electric discharge, the kind of the gas to be introduced into the PDP 1 may be changed. For example, Ne gas is first introduced into the PDP 1 and, after the completion of the electric discharge, $N_2$ gas is introduced instead of the Ne gas. The operation to be performed after the introduction of the cleaning gas is the same as in the first evacuation and gas introduction process.

The construction of the apparatus is complicated by the provision of the discharger 44, but the impurity gases can effectively be removed by causing the electric discharge in the PDP 1 at any stage during the evacuation and gas introduction process.

Fifth Evacuation and Gas Introduction Process

This process employs the same apparatus as in the fourth evacuation and gas introduction process. A PDP 1 is first placed in the oven 35. Any of the PDPs according to the first to tenth embodiments and the PDPs provided with the impurity gas absorbent 34 may be used as the PDP 1. In this process, the temperature of the PDP 1 is controlled in the oven 35 for the evacuation and gas introduction in accordance with the panel temperature profile shown in FIG. 19 unlike in the first evacuation and gas introduction process. That is, the panel temperature control is performed in the same manner as in the second evacuation and gas introduction process.

More specifically, the cleaning gas inlet valve 40 is repeatedly opened and closed for starting and stopping the introduction of the cleaning gas at particular temperatures before the temperature of the PDP 1 reaches the predetermined impurity gas releasable temperature. Every time the cleaning gas inlet valve 40 is opened, the electric discharge is caused in the PDP 1 by actuating the discharger 44 as in the fourth evacuation and gas introduction process. The cleaning gas to be used in this process is the same as in the fourth evacuation and gas introduction process. The operation to be performed after the introduction of the cleaning gas is the same as in the first evacuation and gas introduction process.

Sixth Evacuation and Gas Introduction Process

Figure 22:
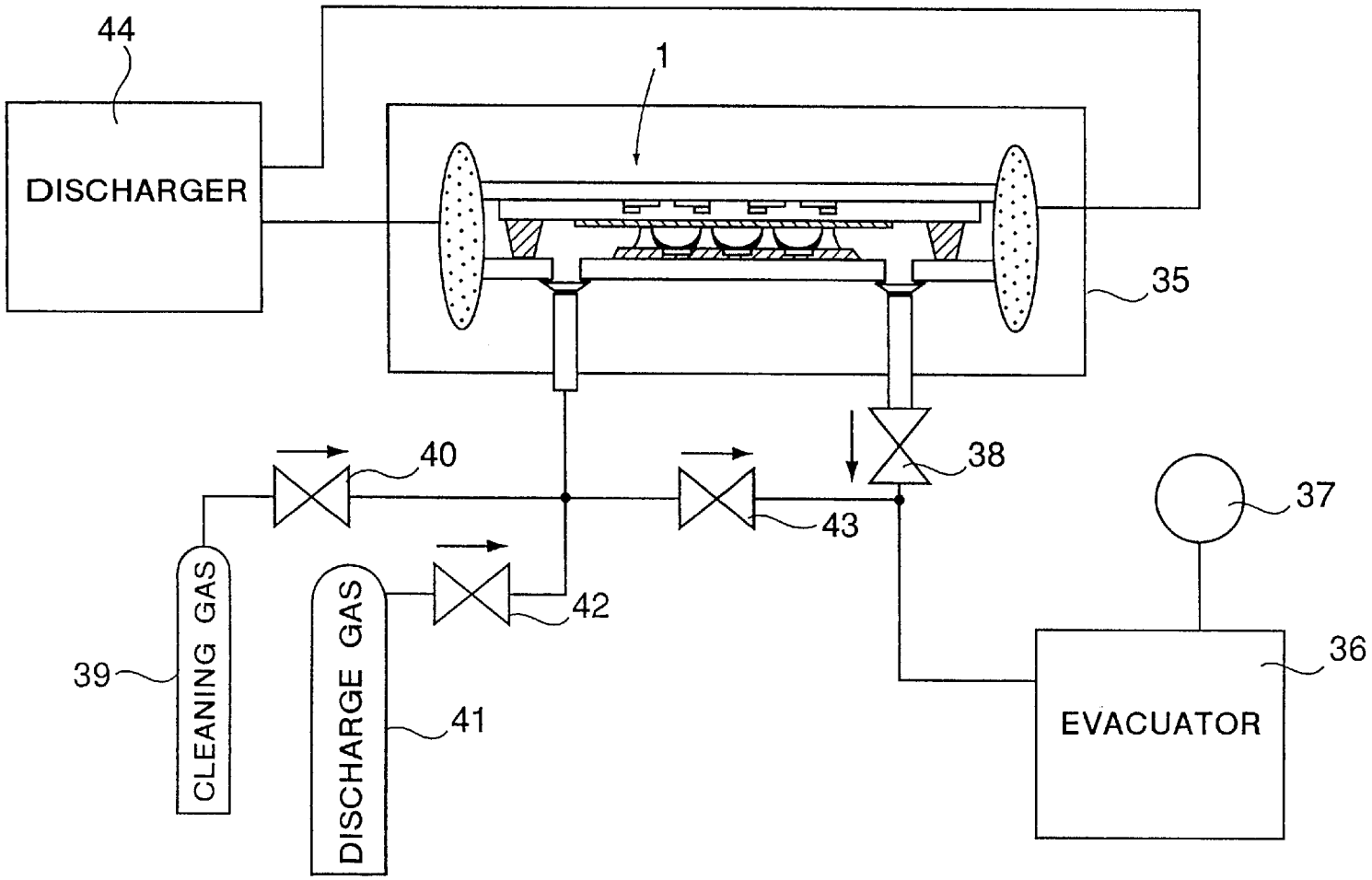
FIG. 22 is a diagram illustrating an evacuation and gas introduction apparatus to be used for a sixth evacuation and gas introduction process according to the present invention.

In this process, an apparatus as shown in FIG. 22 is used for the evacuation and gas introduction for a PDP 1. The apparatus has substantially the same construction as the apparatus shown in FIG. 21, except that the gas inlet pipe and the gas outlet pipe are connected to each other via an evacuation valve 43 provided therebetween. Thus, the vent pipe 33*a* which serves as the gas inlet pipe can also be used for the evacuation. The arrangement and effect of the evacuation valve 43 are the same as described in the third evacuation and gas introduction process.

The evacuation process is performed in substantially the same manner as in the third evacuation and gas introduction process, except that the electric discharge is caused in the PDP 1 by actuating the discharger 44 when the cleaning gas is introduced into the PDP 1 as in the fourth evacuation and gas introduction process. The operation to be performed after the introduction of the cleaning gas is the same as in the third evacuation and gas introduction process.

Next, an explanation will be given to the cleaning electrode to be used for the electric discharge during the evacuation.

Figure 23:
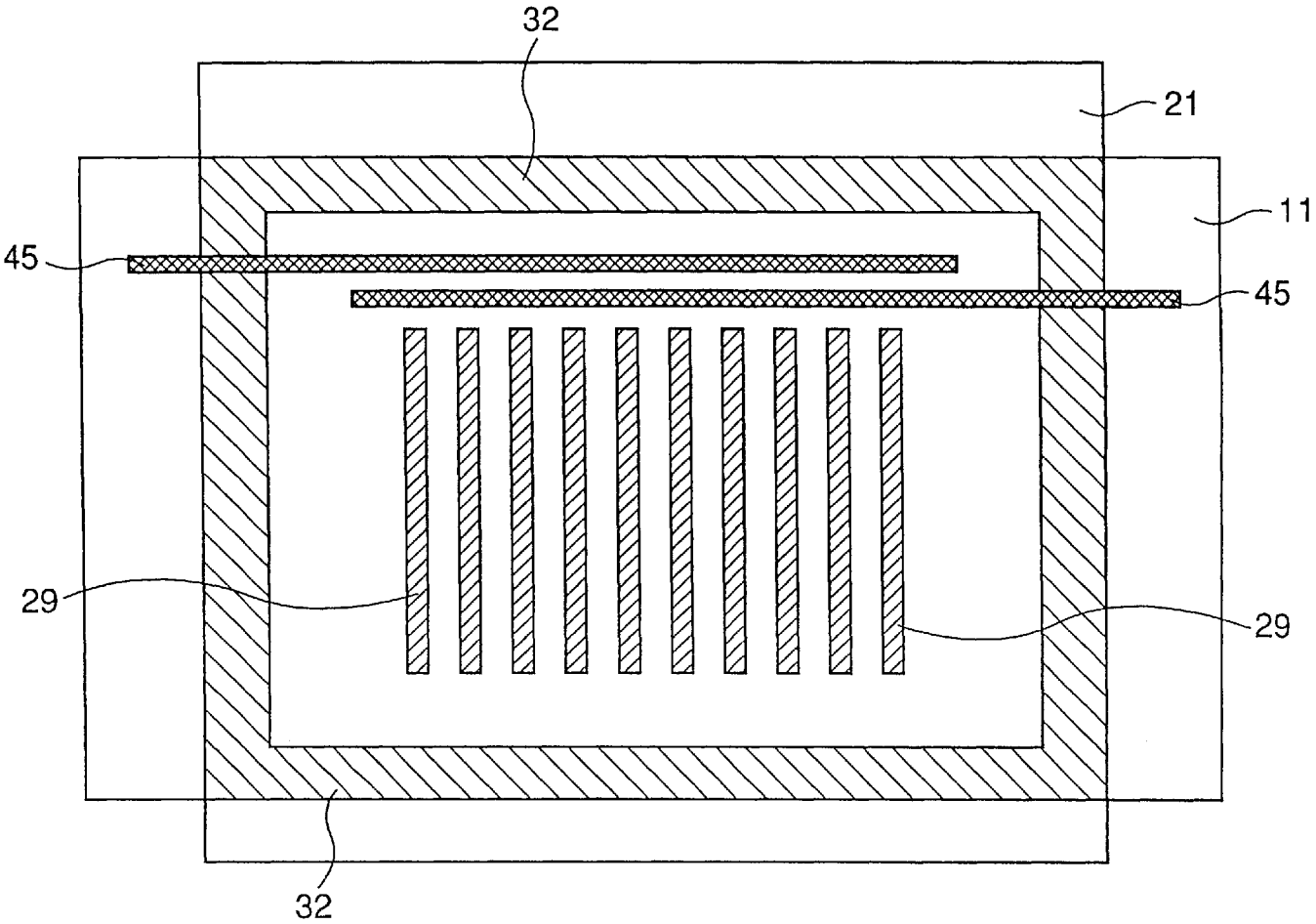
FIG. 23 is an explanatory diagram illustrating an arrangement of electrodes for a cleaning operation according to an embodiment of the present invention.

An exemplary arrangement of the cleaning electrode will be described with reference to FIG. 23. As shown, a pair of cleaning electrodes 45 to be used only in the evacuation process are provided adjacent to the barrier rib arrangement outside the display area on the front substrate 11. Variations of the cleaning electrodes 45 are shown below.

Figure 24:
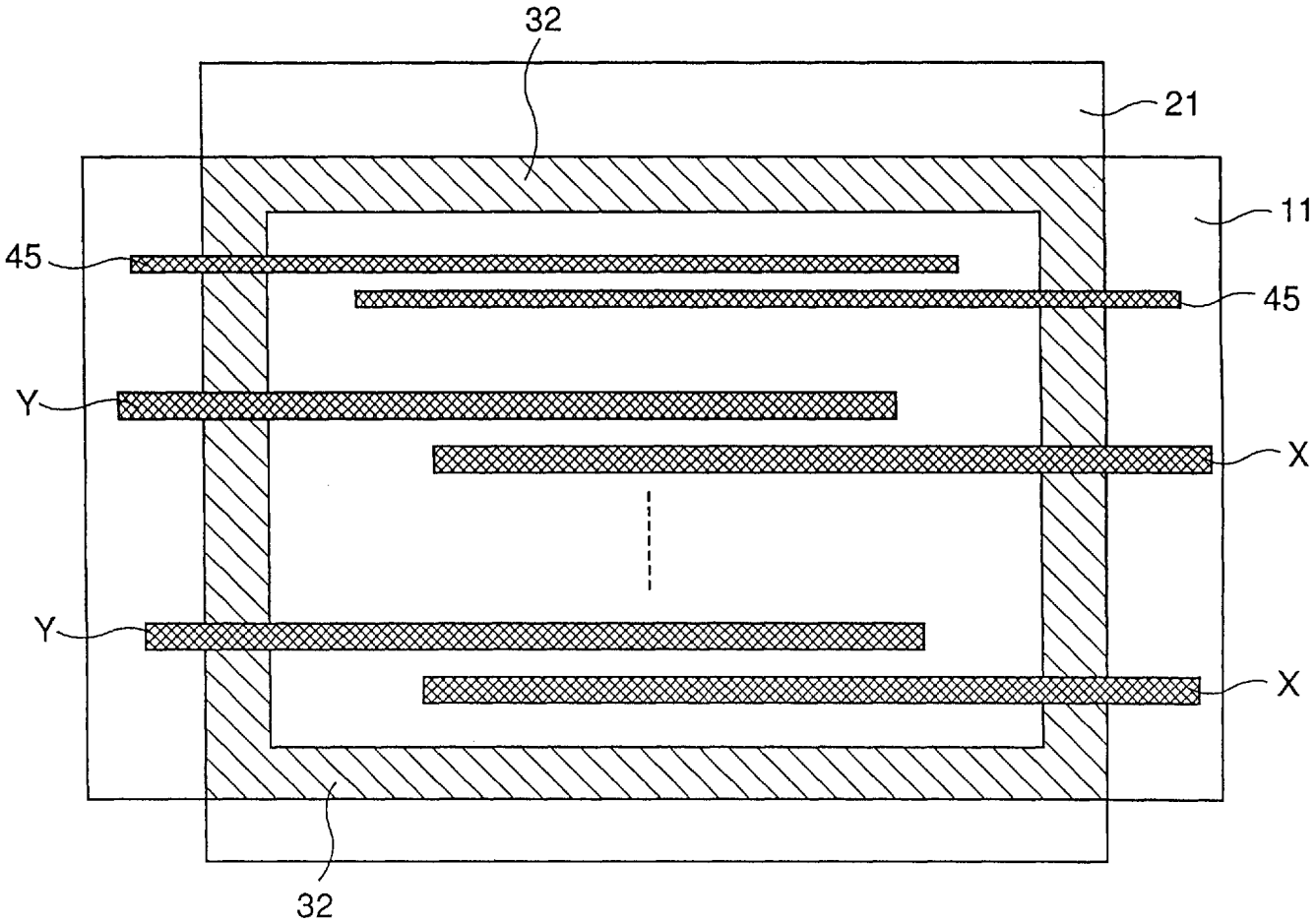
FIG. 24 is an explanatory diagram illustrating an arrangement of electrodes for a cleaning operation according to another embodiment of the present invention where the spacing between the cleaning electrodes is smaller than between the sustain electrodes.

FIG. 24 shows a case where a spacing between the cleaning electrodes 45 is smaller than a spacing of each pair of sustain electrodes X and Y (to be used for the display), so that the electric discharge between the cleaning electrodes 45 can be caused more easily.

Figure 25:
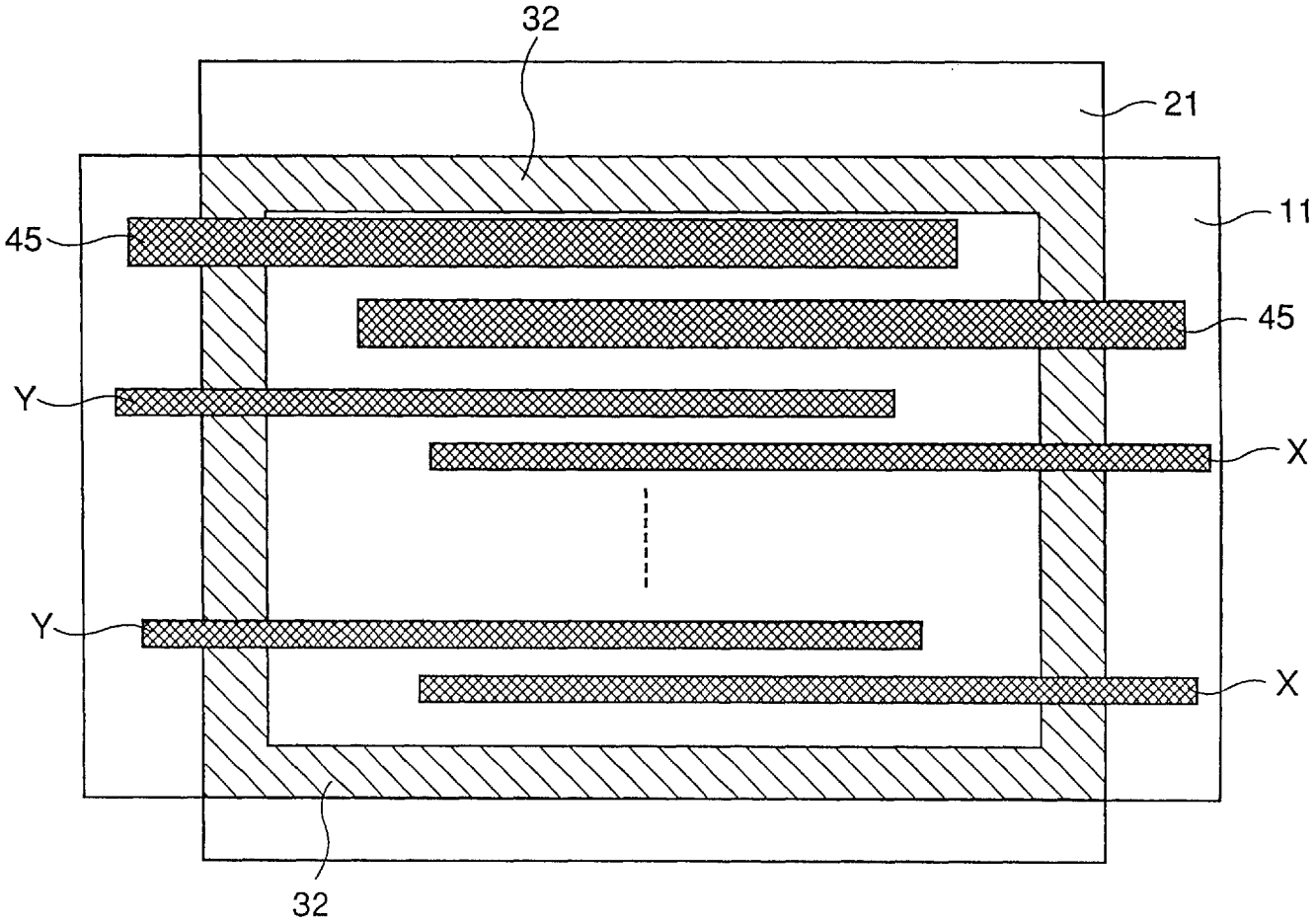
FIG. 25 is an explanatory diagram illustrating an arrangement of electrodes for a cleaning operation according to another embodiment of the present invention where the width of the cleaning electrodes is greater than the sustain electrodes.

FIG. 25 shows a case where the cleaning electrodes 45 each have a greater width than the sustain electrodes X and Y (to be used for the display), so that the electric discharge between the cleaning electrodes 45 can be caused more easily.

Figure 26:
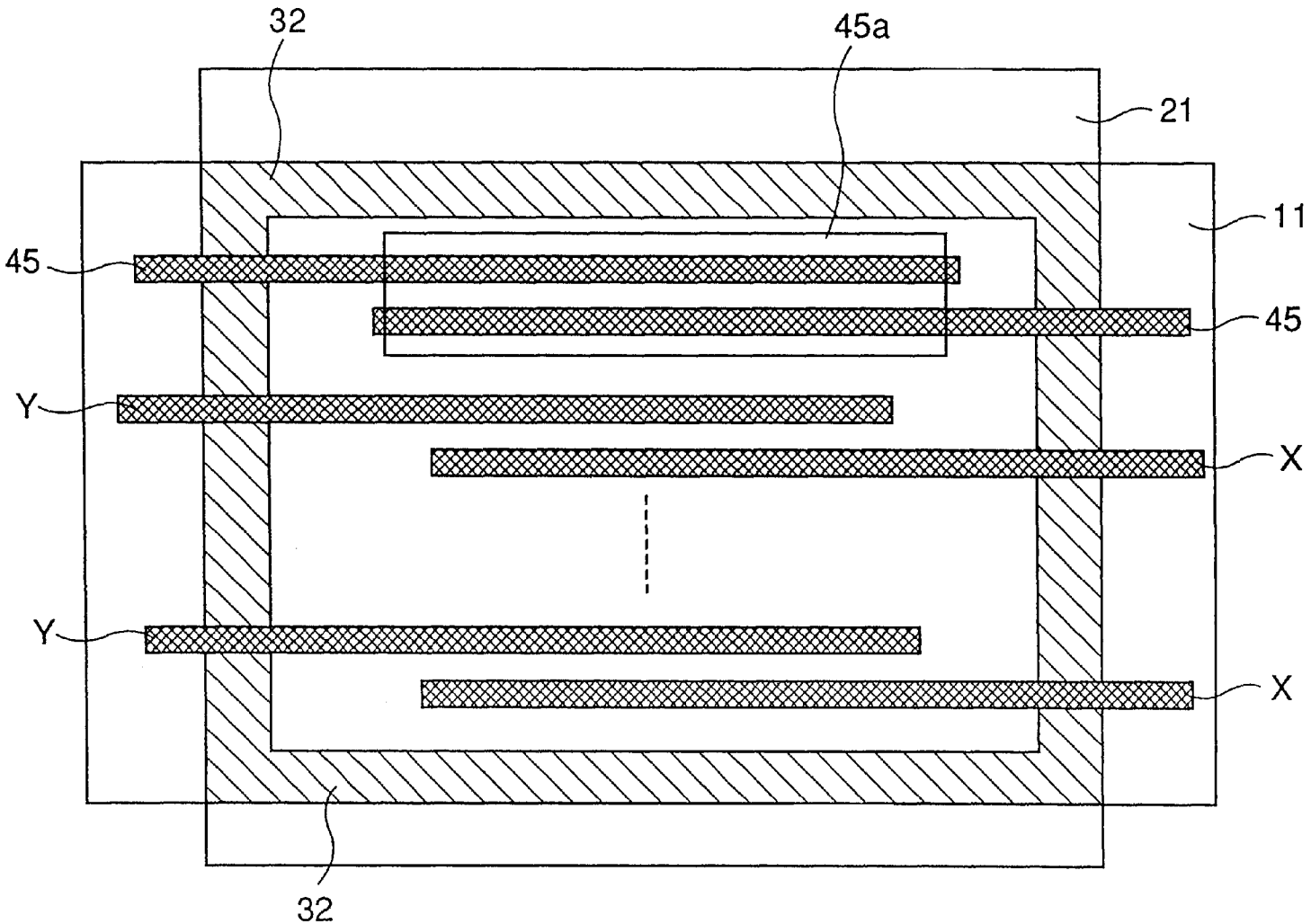
FIG. 26 is an explanatory diagram illustrating an arrangement of electrodes for a cleaning operation according to another embodiment of the present invention where the thickness of the insulating film is less for the portion located on the cleaning electrodes than the thickness located on the sustain electrodes.

FIG. 26 shows a case where a portion of the insulating film located on the cleaning electrodes 45 has a smaller thickness than a portion of the insulating film located on the sustain electrodes X and Y (to be used for the display), so that the electric discharge between the cleaning electrodes 45 can be caused more easily. In FIG. 26, a portion of the insulating film within an area 45*a* has a reduced thickness.

In the cases described above, the cleaning electrodes 45 are provided on the same front substrate 11 to cause surface discharge, but the arrangement and structure of the electrodes 45 are not necessarily adapted for surface discharge. The cleaning electrode may be adapted to cause opposed discharge.

Figure 27:
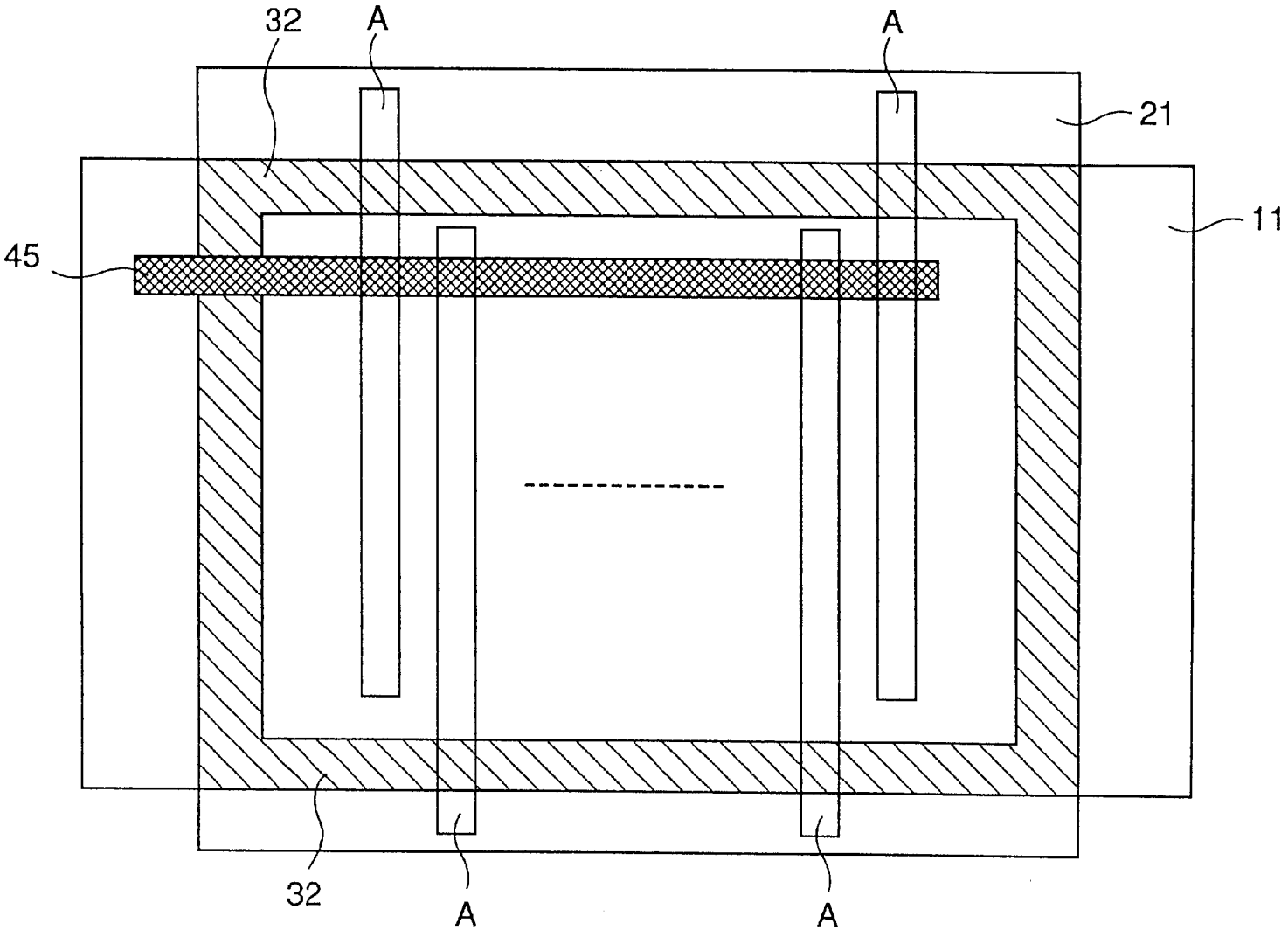
FIG. 27 is an explanatory diagram illustrating an arrangement of electrodes for a cleaning operation according to an embodiment of the present invention where the cleaning electrodes are adapted to cause opposed discharge.
Figure 28:
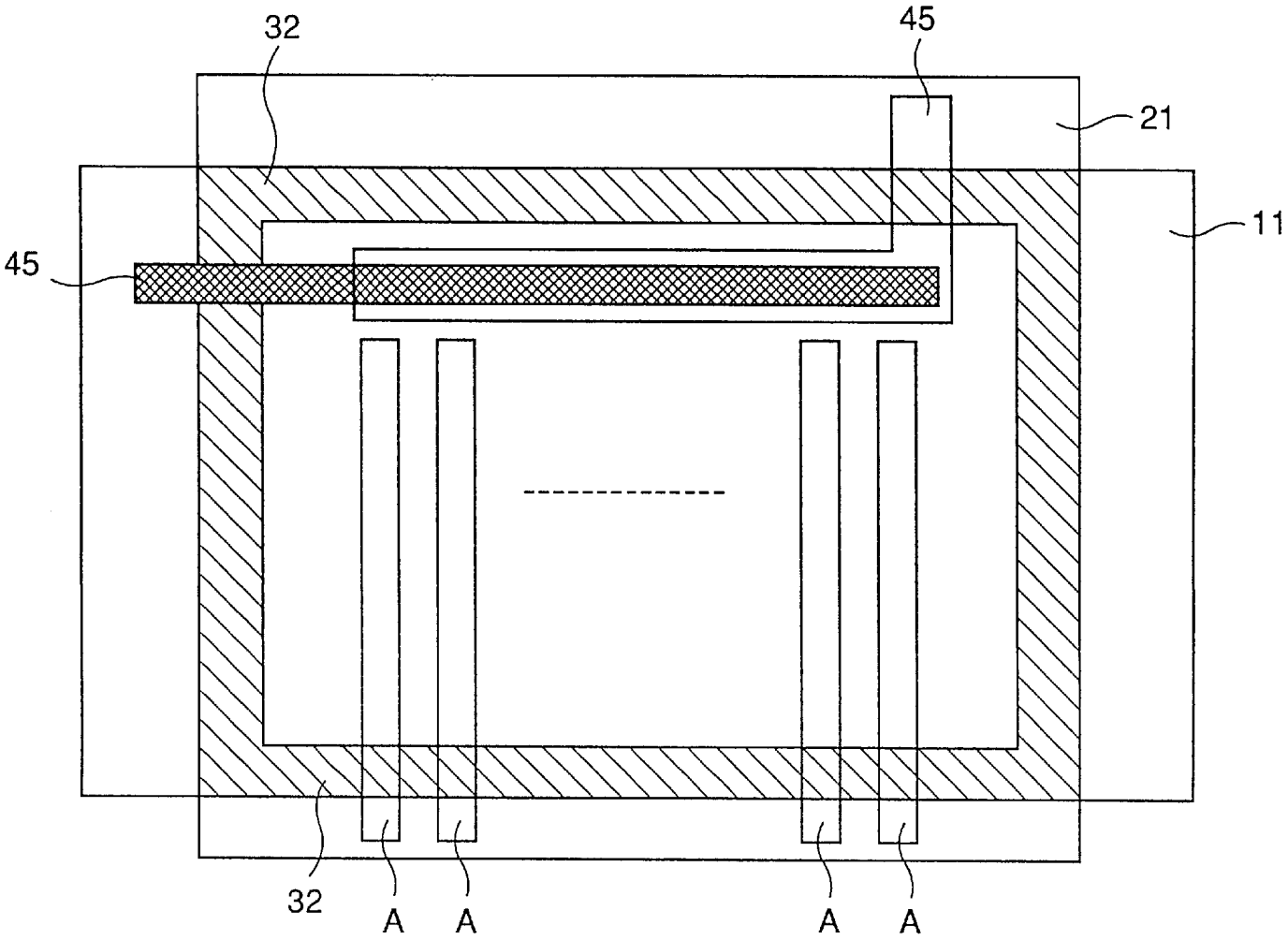
FIG. 28 is an explanatory diagram illustrating an arrangement of electrodes for a cleaning operation according to another embodiment of the present invention where the cleaning electrodes are differently adapted to cause opposed discharge.

FIGS. 27 and 28 show exemplary arrangements of the cleaning electrode adapted for the opposed discharge.

FIG. 27 shows a case where a single cleaning electrode 45 is provided on the front substrate 11 and electric discharge for the cleaning is caused between the cleaning electrode 45 on the front substrate 11 and the address electrodes A on the rear substrate 21.

FIG. 28 shows a case where the address electrodes A provided on the rear substrate 21 extend from one side of the rear substrate 21 and a pair of cleaning electrodes 45 are provided in association with each other on the front substrate 11 and the rear substrate 21, respectively, so that electric discharge for the cleaning is caused between the pair of cleaning electrodes 45.

The opposed discharge can be realized by employing the electrode arrangements described above. Although one pair of cleaning electrodes 45 are provided adjacent to one side of the panel in the aforesaid cases, plural pairs of cleaning electrodes 45 may be provided adjacent to two or more sides of the panel as long as the provision of the cleaning electrodes does not adversely influence the display characteristics of the panel.

Barrier ribs may be provided on the surface of the front substrate 11 formed with the cleaning electrode 45. The barrier ribs may be arranged in a meshed configuration or in a striped configuration, for example. The cleaning electrodes 45 each have a linear configuration in the aforesaid cases, but may be of any shape, e.g., a comb shape.

The arrangement of the cleaning electrodes 45 described above is applicable to any of the PDPs according to the first to tenth embodiments.

An evacuation and discharge gas introduction process for the PDPs having the aforesaid constructions and an apparatus to be employed for this process will be described by way of the following seventh evacuation and gas introduction process.

Seventh Evacuation and Gas Introduction Process

Figure 29:
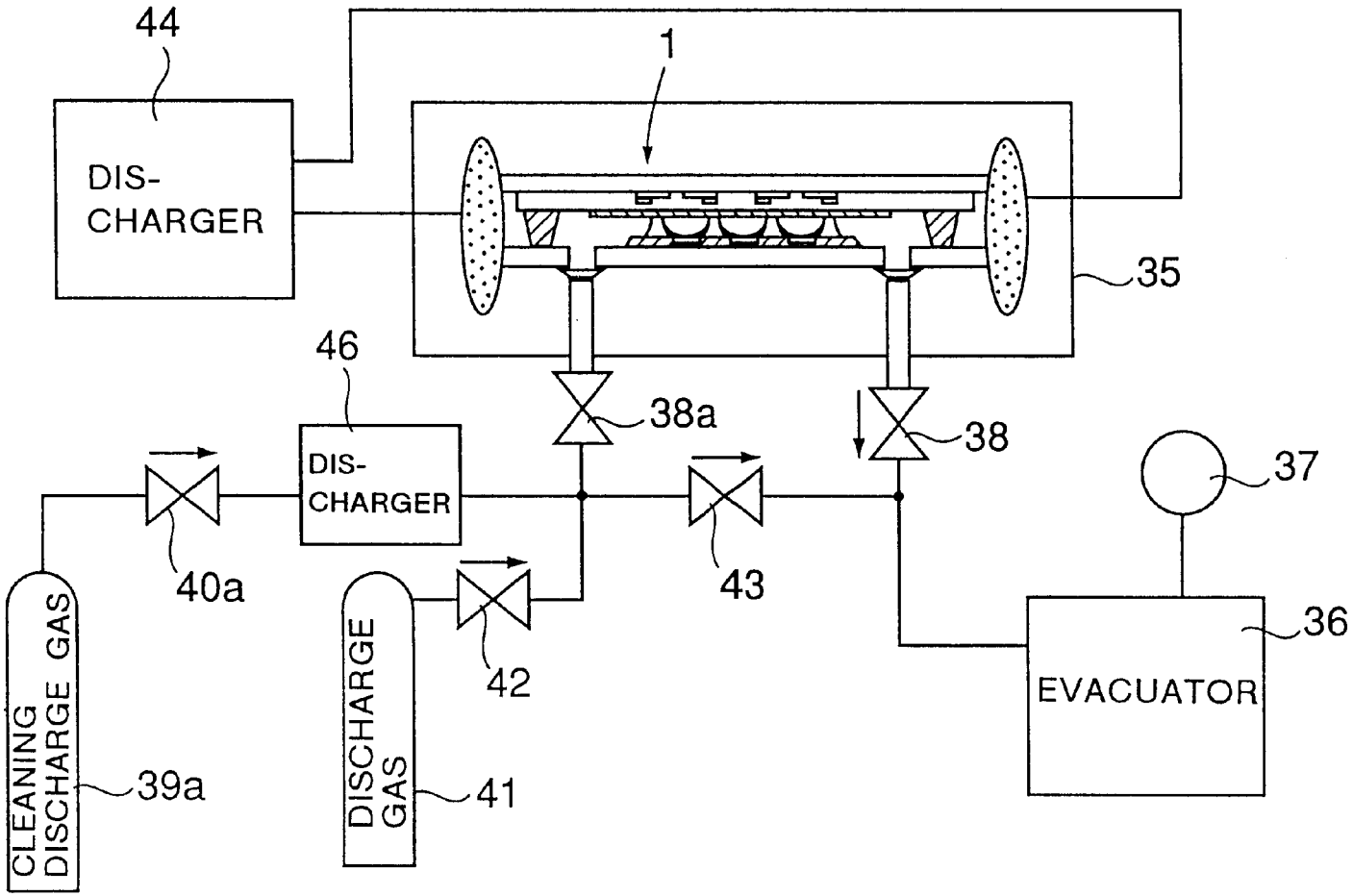
FIG. 29 is a diagram illustrating an evacuation and gas introduction apparatus to be used for a seventh evacuation and gas introduction process according to the present invention.

In this process, an apparatus as shown in FIG. 29 is used for the evacuation and gas introduction for a PDP 1. In FIG. 29, the apparatus is shown as including components typically required for the evacuation and gas introduction process, but the apparatus is not necessarily required to include all these components.

Where a single vent pipe is attached to the PDP 1, a valve serving as both an evacuation valve and a gas inlet valve is fitted to the vent pipe. Where a plurality of vent pipes are attached to the PDP 1, the vent pipes are respectively connected to an evacuation valve 38 which is further connected to an evacuator 36, and to a gas inlet valve 38*a* which is further connected to a discharge gas cylinder 41 and a cleaning discharge gas cylinder 39*a*. These vent pipes are connected to each other via an evacuation valve 43, so that the functions of the vent pipes can be interchanged.

The flow path for a cleaning discharge gas is established so that the vent pipe located adjacent to the cleaning electrodes in the PDP 1 can serve as a gas inlet pipe for introduction of the cleaning discharge gas into the PDP 1. For preliminary ionization of the cleaning discharge gas by electric discharge, a discharger 46 is provided in a flow path adjacent to the cleaning gas inlet valve 40*a*. For electric discharge within the panel, a discharger 44 is connected to predetermined electrodes provided in the panel for applying thereto a voltage of a given waveform.

Usable as the cleaning discharge gas are any gases that do not adversely affect the panel characteristics when used for the removal of the impurity gases. Plural kinds of gases may be used as the cleaning discharge gas. Examples of the cleaning discharge gas include $N_2$, Ne, He, Ar and gas mixtures thereof. The discharge gas may be used as the cleaning discharge gas.

Figure 30:
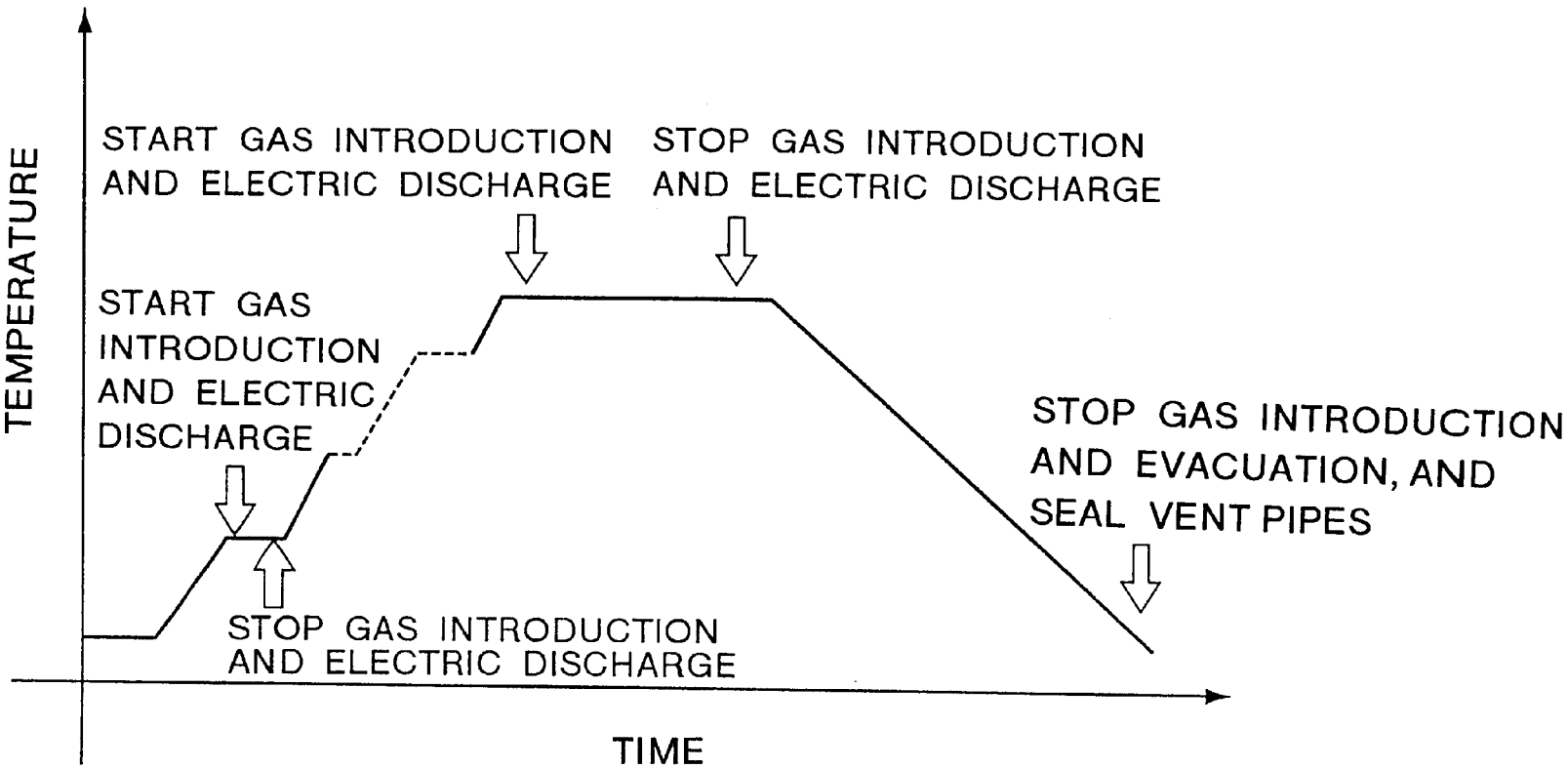
FIG. 30 is a graphical representation illustrating a panel temperature profile to be employed for the evacuation and gas introduction process for a PDP having an electrode for the cleaning operation.

The evacuation process is performed in the following manner. First, the PDP 1 is placed in an oven 35 for controlling the temperature of the panel. The PDP 1 is evacuated by the evacuator 36 with all the gas inlet valves closed and with the evacuation valve 38 opened. While the PDP 1 is thus evacuated, the temperature of the PDP 1 is controlled in the oven 35 in accordance with a panel temperature profile as shown in FIG. 30.

When the temperature of the PDP 1 reaches a predetermined level, the evacuation valve 38 is closed and the gas inlet valve 38*a* is opened in the gas introduction process. Then, the cleaning discharge gas inlet valve 40*a* is opened, so that the cleaning discharge gas is introduced into the PDP 1 from the gas inlet pipe. The introduction of the cleaning discharge gas may be repeated any number of times as required.

The cleaning discharge gas is highly ionized into plasma gas by electric discharge in the discharger 46, and the plasma gas thus generated is introduced into the PDP 1 for removal of the impurity gases. Where the PDP 1 has a plurality of gas inlet pipes, the removal of the impurity gases can effectively be carried out.

There will next be explained a process for causing electric discharge in the PDP 1.

In this process, the cleaning discharge gas is introduced into the PDP 1 in the same manner as in the seventh evacuation and gas introduction process. The cleaning discharge gas is highly ionized into plasma gas including priming particles in the PDP 1 by electric discharge caused by applying a voltage to the cleaning electrodes provided outside the display area in the PDP 1. The cleaning discharge gas may preliminarily be ionized by electric discharge caused by the discharger 46 before the introduction thereof into the PDP 1.

Figure 31:
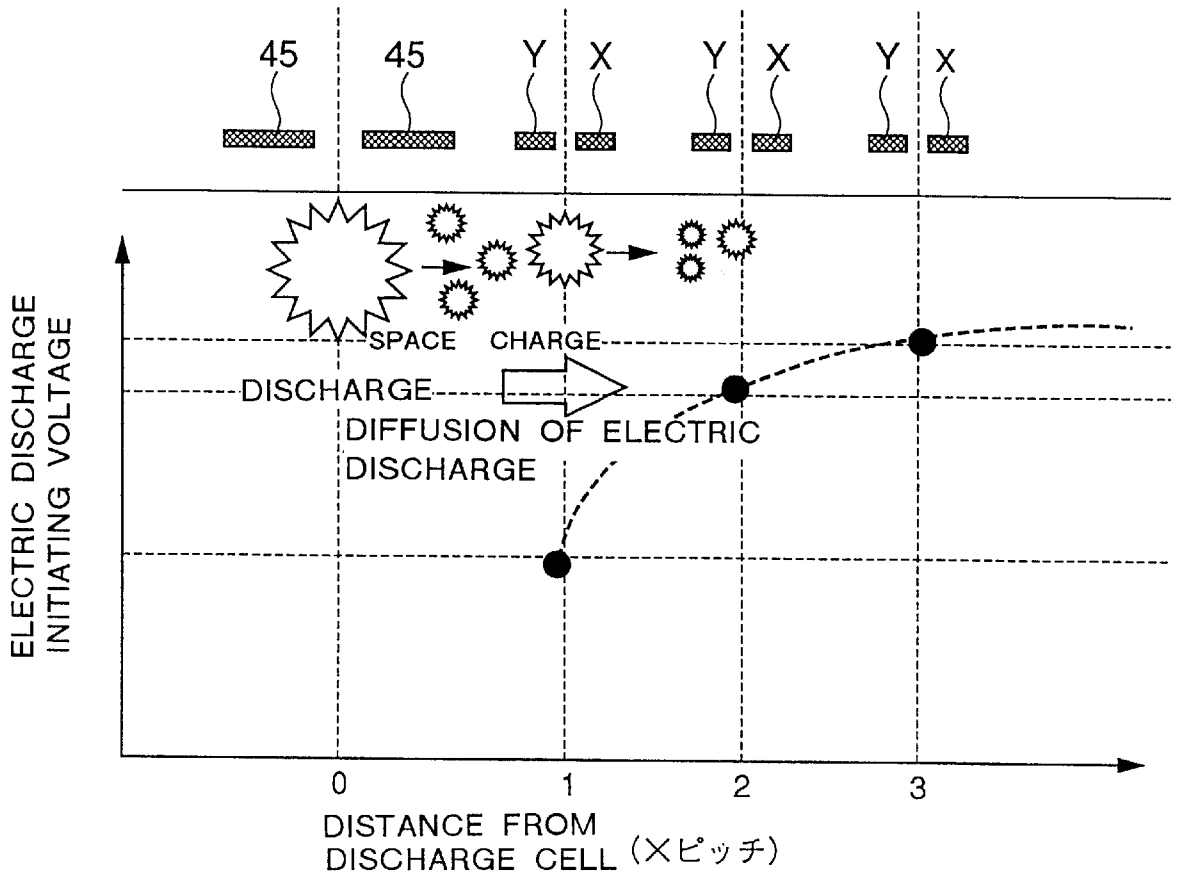
FIG. 31 is a diagram illustrating diffusion of electric discharge in accordance with the present invention.

Since no barrier rib is provided in the peripheral area where the cleaning electrodes are provided, the electric discharge homogeneously diffuses from one side of the PDP 1 throughout the PDP 1, so that the priming particles are homogeneously distributed throughout the PDP 1. As shown in FIG. 31, a voltage required for initiating the electric discharge in the display area can be lowered by a priming effect of the priming particles. The electric discharge is initiated by application of a relatively low voltage even on the surface of the MgO protective layer on which the impurity gases are adsorbed. Thus, the electric discharge diffuses from the area where the priming particles are first generated.

Figure 32:
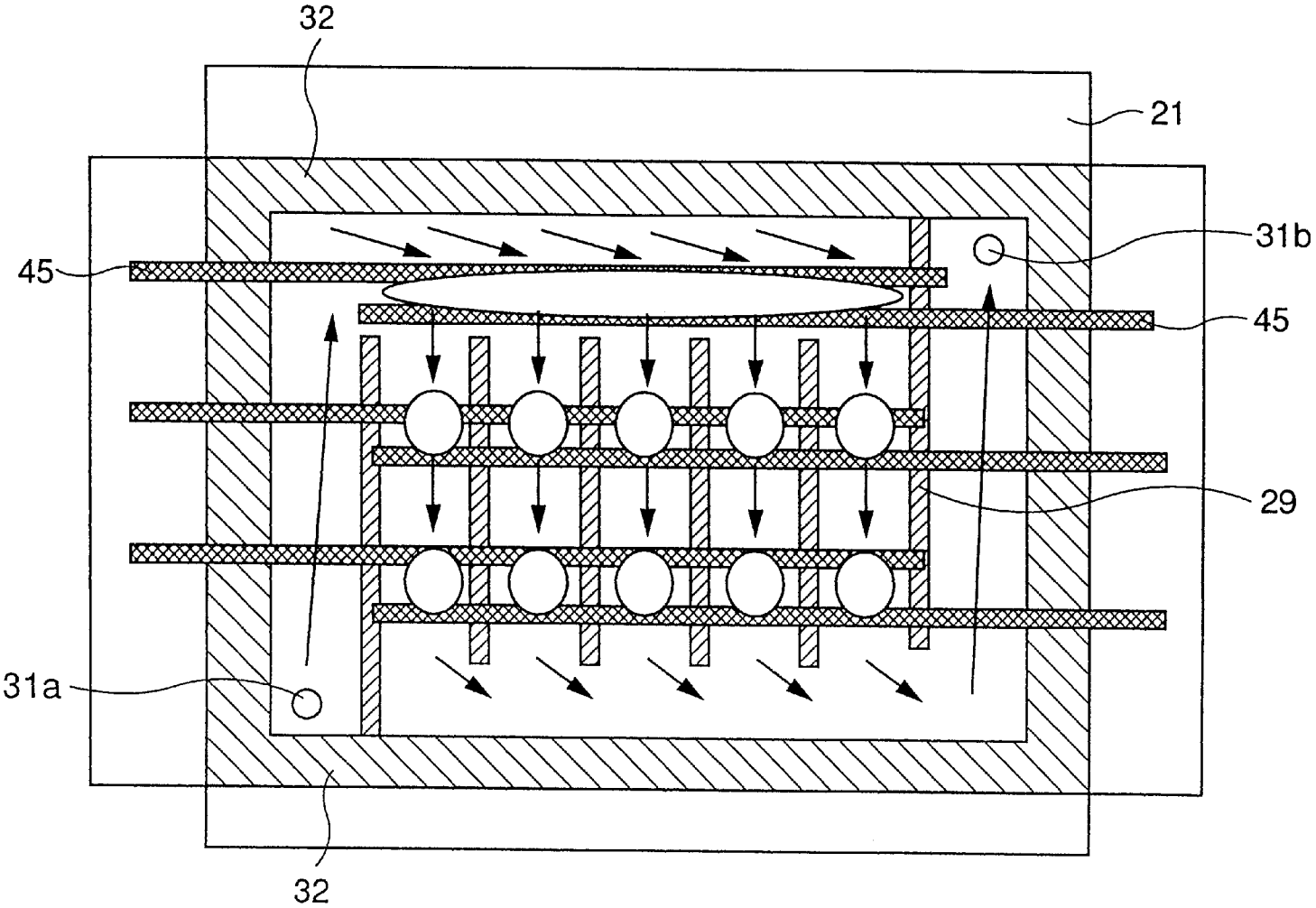
FIG. 32 is a diagram illustrating diffusion of electric discharge in the case where electrodes for the cleaning operation are provided in the PDP according to the third embodiment.
Figure 33:
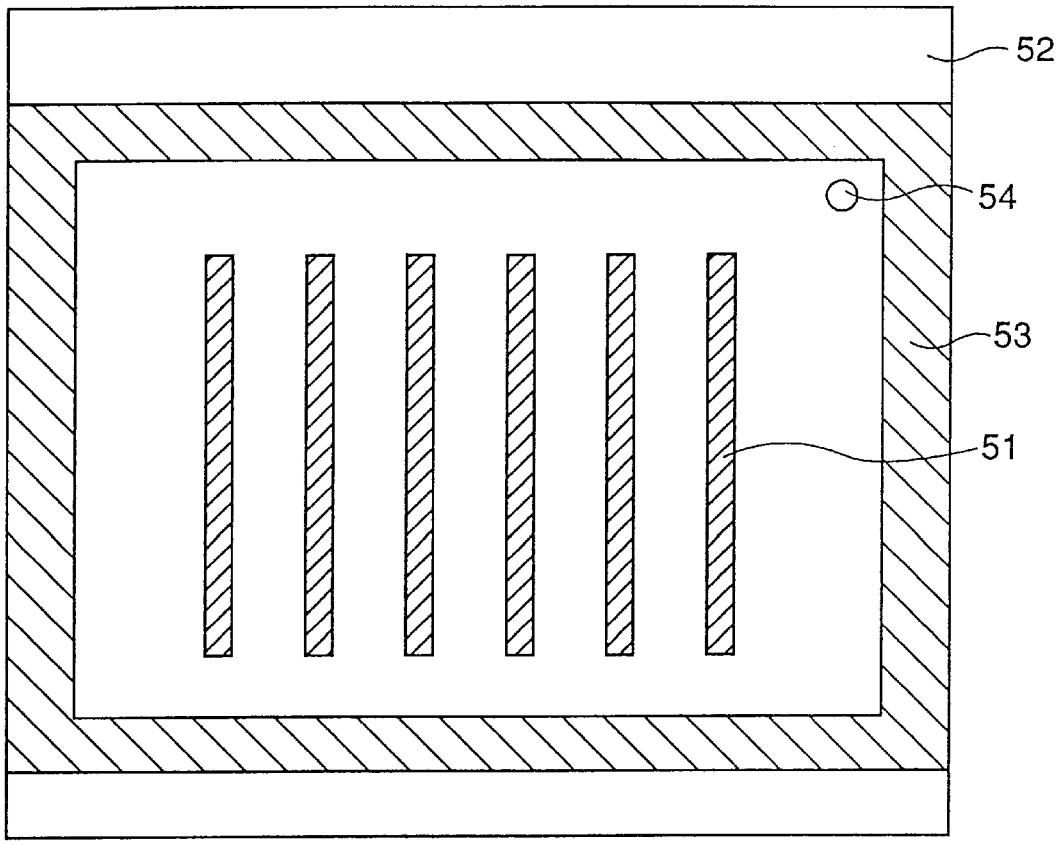
FIG. 33 (PRIOR ART)
FIG. 33 is a diagram illustrating a conventional barrier rib arrangement of a PDP.
Figure 34A:
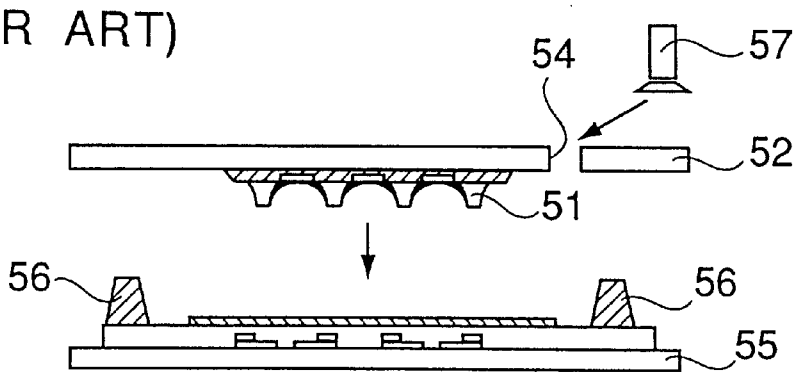
FIG. 34A (PRIOR ART)
FIGS. 34A, 34B and 34C are diagrams for explaining a substrate combining process, a vent pipe attaching process and an evacuation and gas introduction process, respectively, according to the prior art.
Figure 34B:
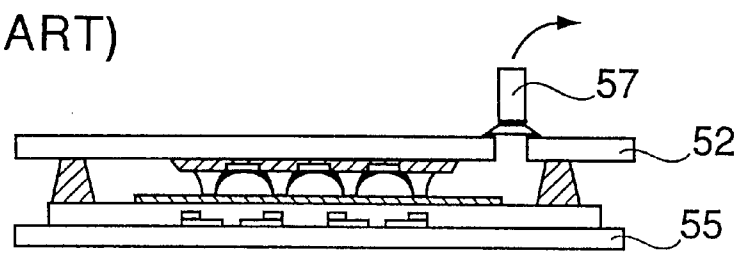
FIG. 34B (PRIOR ART)
Figure 34C:
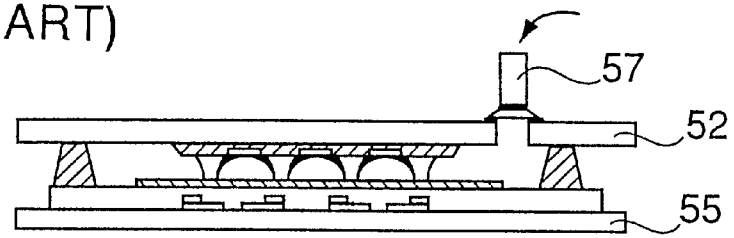
FIG. 34C (PRIOR ART)
Figure 35:
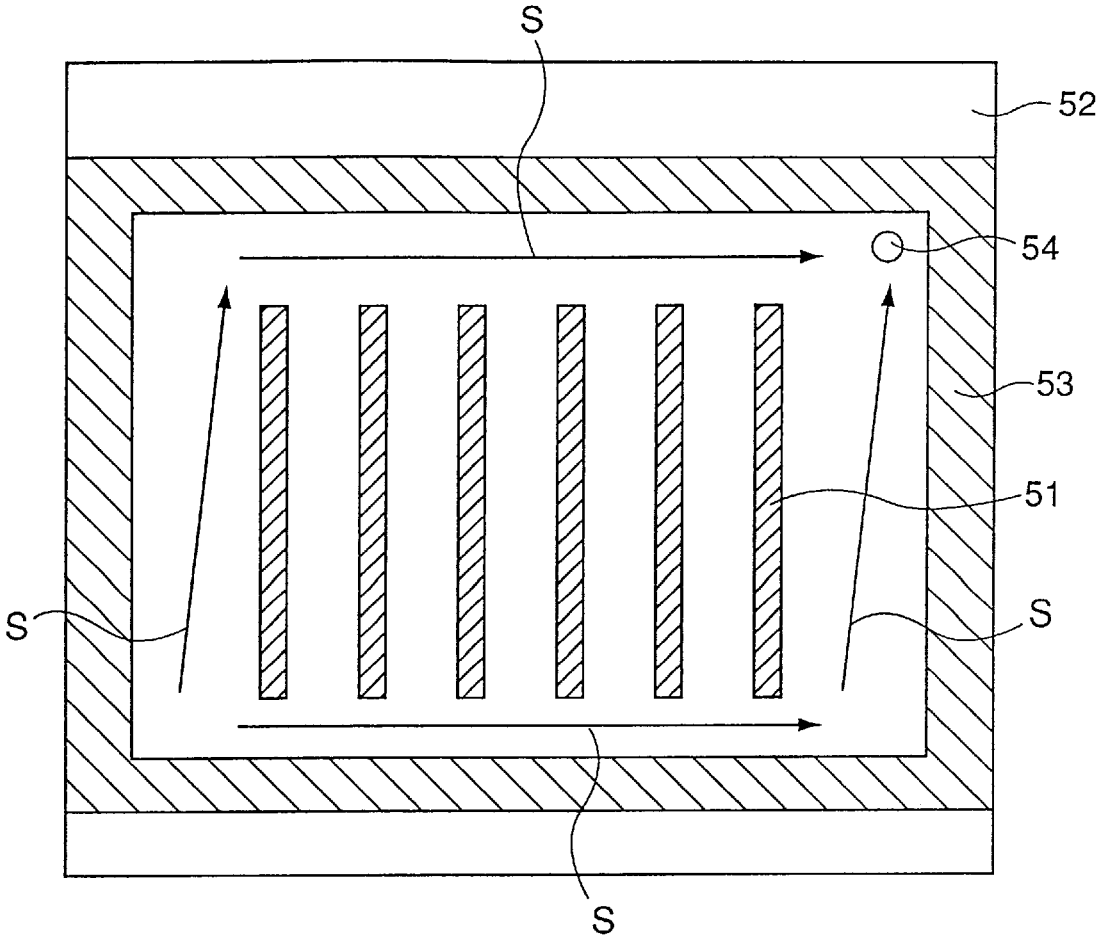
FIG. 35 (PRIOR ART)
FIG. 35 is a diagram illustrating a flow of impurity gases in the conventional PDP.
Figure 36:
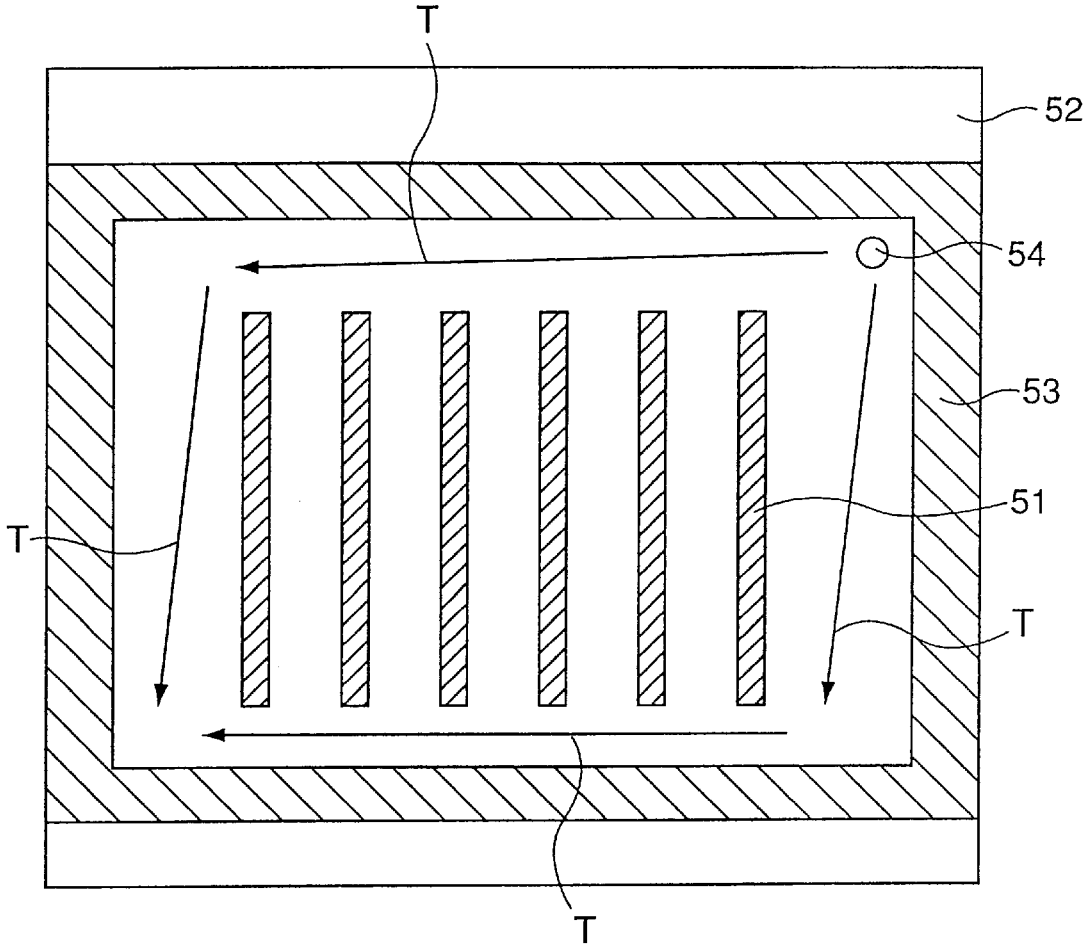
FIG. 36 (PRIOR ART)
FIG. 36 is a diagram illustrating a flow of a discharge gas in the conventional PDP.
Figure 37:
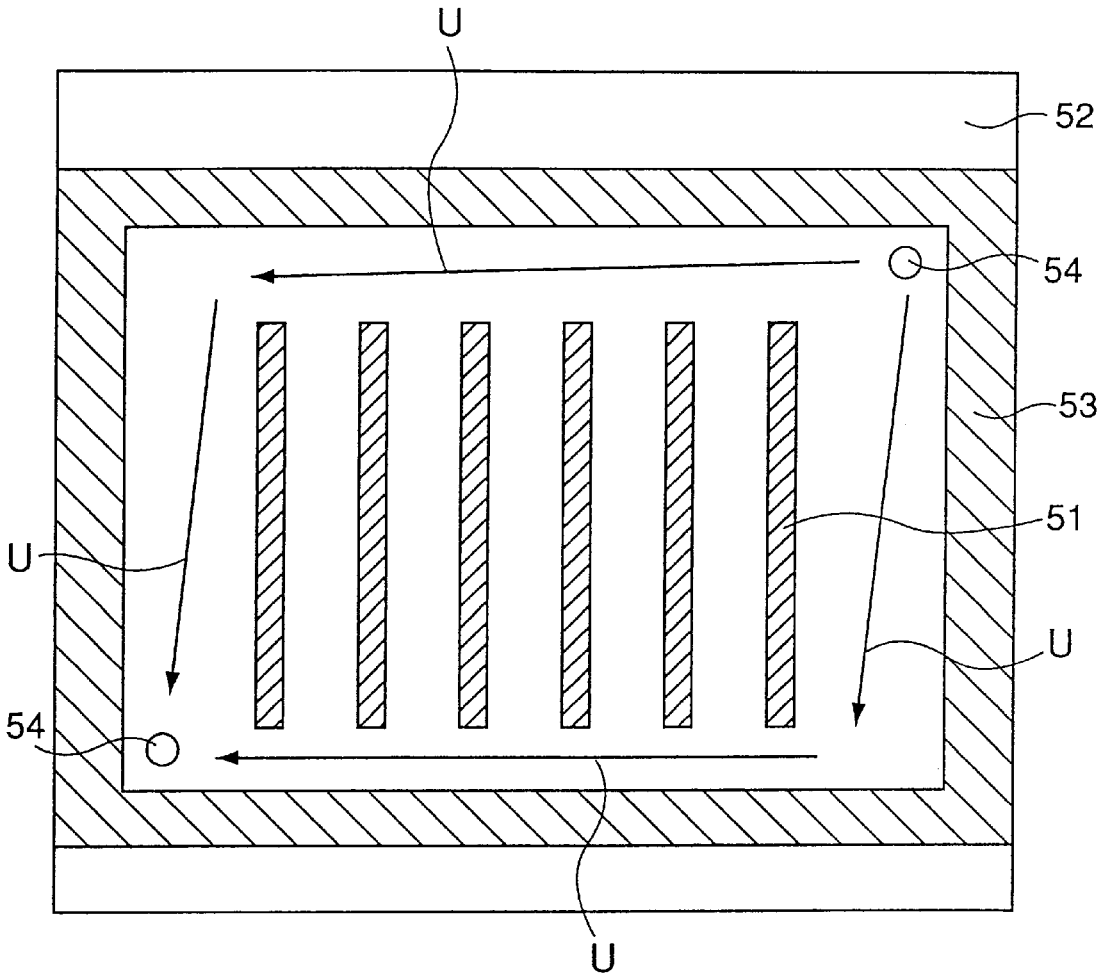
FIG. 37 (PRIOR ART)
FIG. 37 is a diagram illustrating a flow of a gas in a conventional PDP having two vent holes.

FIG. 32 is a diagram illustrating electric discharge caused in the PDP according to the third embodiment in which the cleaning electrodes are provided. As shown, the introduction of the cleaning discharge gas from the vent hole 31*a* allows for more effective diffusion of the electric discharge than the conventional method. The priming particles are distributed throughout the display area in the PDP to cause the electric discharge in the display area for the removal of the impurity gases. The operation of causing the electric discharge in the PDP by introduction of the cleaning discharge gas may repeatedly be performed any number of times at suitable temperatures.

After the completion of the aforesaid process, the evacuation valve 38 is opened for evacuation of the PDP, and the PDP is cooled to room temperature. After the temperature of the PDP reaches room temperature, the evacuation valve 38 is closed, and the discharge gas is introduced into the PDP with the discharge gas inlet valve 42 opened until the internal pressure of the PDP reaches a predetermined level.

The evacuation and gas introduction for any of the PDPs having the barrier rib arrangements according to the first to tenth embodiments and the PDPs provided with the impurity gas absorbent can be achieved in accordance with the first to sixth evacuation and gas introduction processes or the seventh evacuation and gas introduction process which employs the cleaning electrodes to clean the inside of the PDP by electric discharge. Thus, the impurity gases can completely be expelled from the plasma display panel and the discharge gas can be introduced into the panel. Since the impurity gases can completely be removed from the PDP, the display characteristics of the PDP can be improved in comparison with the conventional PDPs.

Although the embodiments of the present invention have thus been described by employing the AC-driven color PDP as the PDP, the present invention is not limited thereto. The present invention can be applied to any kinds of PDPs having barrier ribs formed therein.

In accordance with the present invention, the impurity gases remaining in the gas discharge panel can assuredly be removed from the panel, so that the display characteristics of the panel can be improved. Further, the time required for the evacuation and gas introduction process can be shortened, thereby improving the productivity.

What is claimed is:

1. A gas discharge panel comprising:

a pair of substrates defining an electric discharge space therebetween;

a plurality of barrier ribs arranged parallel to each other in a striped configuration within a display area in the electric discharge space for partitioning the electric discharge space;

a sealing member provided between the pair of substrates on the periphery thereof; and at least two gas flow barriers, wherein one of the substrates has a first vent hole and a second vent hole provided in a peripheral portion thereof for intercommunication between an inside and outside of the panel, and the at least two gas flow barriers are provided in peripheral spaces between the sealing member and the barrier ribs located on opposite sides of an arrangement of the barrier ribs and positioned relative to the sealing member and the barrier ribs so that a gas introduced from the first vent hole is restricted from flowing into the peripheral spaces and instead flows through inter-rib spaces defined between adjacent pairs of barrier ribs and is expelled from the second vent hole.

2. A gas discharge panel of claim 1, wherein the first vent hole and the second vent hole are located in a diagonally opposite relation in the panel, and a plurality of gas flow barriers are provided in a staggered manner between the respective barrier ribs and either of opposed interior surfaces of the sealing member so that the gas can flow through the inter-rib spaces successively.

3. A gas discharge panel of claim 1, wherein the first vent hole and the second vent hole are located in juxtaposition adjacent to one side of the panel, and a plurality of gas flow barriers are provided in a staggered manner between the respective barrier ribs and either of opposed interior surfaces of the sealing member so that the gas can flow through the inter-rib spaces successively.

4. A gas discharge panel of claim 1, wherein the first vent hole and the second vent hole are located in a diagonally opposite relation in the panel, and the gas flow barriers are respectively be provided adjacent to the first vent hole between the sealing member and one end of a barrier rib located on one side of the barrier rib arrangement and adjacent to the second vent hole between the sealing member and one end of a barrier rib located on the other side of the barrier rib arrangement.

5. A gas discharge panel of claim 1, wherein at least one of the first vent hole and the second vent hole includes a plurality of vent holes.

6. A gas discharge panel of claim 1, wherein the first vent hole includes a pair of vent holes which are located in juxtaposition adjacent to one of opposed sides of the panel, and the second vent hole includes a pair of vent holes which are located in juxtaposition adjacent to the other side of the panel, and wherein the gas flow barriers are provided between the sealing member and side faces of the barrier ribs located on the opposite sides of the barrier rib arrangement.

7. A gas discharge panel of claim 1, wherein the gas flow barriers are formed integrally with the corresponding barrier ribs or the sealing member.

8. A gas discharge panel of claim 1, wherein a cleaning electrode for causing electric discharge to ionize the gas for cleaning the electric discharge space is provided adjacent to the first vent hole in the peripheral space defined between the sealing member and the barrier ribs.

9. A gas discharge panel of claim 8, wherein the cleaning electrode comprises a pair of electrodes arranged parallel to each other perpendicularly to the barrier ribs.

10. A gas discharge panel comprising:

a pair of substrates defining an electric discharge space therebetween;

a plurality of barrier ribs arranged parallel to each other in a striped configuration within a display area in the electric discharge space for partitioning the electric discharge space;

a sealing member provided between the pair of substrates on the periphery thereof; and at least two gas flow barriers, wherein one of the substrates has a first vent hole and a second vent hole provided in a peripheral portion thereof for intercommunication between an inside and outside of the panel, wherein a cleaning electrode, which causes electric discharge to ionize a gas used to clean the electric discharge space, is provided adjacent to the first vent hole in a peripheral space defined between the sealing member and the barrier ribs, wherein the at least two gas flow barriers are provided between the sealing member and the barrier ribs located on opposite sides of an arrangement of the barrier ribs and positioned relative to the sealing member and the barrier ribs such that a space between the at least two gas barriers and an internal surface of the sealing member is smaller than an inter-rib spacing so that a gas introduced from the first vent hole flows through inter-rib spaces defined between adjacent pairs of barrier ribs and is expelled from the second vent hole, and wherein one of the substrates has address electrodes arranged parallel to the barrier ribs on an interior surface thereof, and the cleaning electrode is disposed perpendicularly to the barrier ribs on an interior surface of the other substrate, so that the electric discharge is caused between the cleaning electrode and the address electrodes to ionize the gas for the cleaning of the electric discharge space of the panel.

11. A gas discharge panel comprising:

a pair of substrates defining an electric discharge space therebetween; a sealing member provided between the pair of substrates on the periphery thereof;

a plurality of barrier ribs arranged parallel to each other in a striped configuration within a display area in the electric discharge space for partitioning the electric discharge space; and a gas flow barrier for hindering gas flow provided in a non-display area defined between the display area and the sealing member so that the non-display area has a smaller gas flow conductance than an elongated inter-rib space defined between each adjacent pair of barrier ribs.

12. An evacuation method for a gas discharge panel, wherein the panel comprises a pair of substrates defining an electric discharge space therebetween, a plurality of barrier ribs arranged parallel to each other in a striped configuration within a display area in the electric discharge space for partitioning the electric discharge space, a sealing member provided between the pair of substrates on the periphery thereof, at least two gas flow barriers, and a cleaning electrode, which causes electric discharge to ionize the gas for cleaning the electric discharge space, is provided adjacent to the first vent hole in a peripheral space defined between the sealing member and the barrier ribs, wherein one of the substrates has address electrodes arranged parallel to the barrier ribs on an interior surface thereof, and the cleaning electrode is disposed perpendicularly to the barrier ribs on an interior surface of the other substrate, so that the electric discharge is caused between the cleaning electrode and the address electrodes to ionize the gas for the cleaning of the electric discharge space of the panel, wherein one of the substrates has a first vent hole and a second vent hole provided in a peripheral portion thereof for intercommunication between an inside and outside of the panel, and the at least two gas flow barriers are provided between the sealing member and the barrier ribs located on opposite sides of an arrangement of the barrier ribs and positioned relative to the sealing member and the barrier ribs such that a space between the at least two gas barriers and an internal surface of the sealing member is smaller than an inter-rib spacing so that a gas introduced from the first vent hole flows through inter-rib spaces defined between adjacent pairs of barrier ribs and is expelled from the second vent hole, the method comprising:

introducing the gas into the panel from the first vent hole while evacuating the panel; and causing electric discharge by the cleaning electrode to ionize the introduced gas for cleaning the electric discharge space in the panel.

13. An evacuation method of claim 12, further comprising inducing electric discharge to be caused by discharge electrodes of the panel in the electric discharge space by utilizing as an electric discharge inducer the gas ionized through the electric discharge caused by the cleaning electrode and the address electrodes.

14. A plasma display panel comprising:

a pair of substrates defining an electric discharge space therebetween;

a sealing member provided between the pair of substrates on the periphery thereof;

a plurality of barrier ribs arranged parallel to each other in a striped configuration in a display area in the electric discharge space that partition the electric discharge space; and a gas flow barrier positioned in a non-display area defined between the display area and the sealing member such that the non-display area has a smaller gas flow conductance than an elongated inter-rib space defined between each adjacent pair of barrier ribs.

15. A gas discharge panel comprising:

a pair of substrates defining an electric discharge space therebetween;

a sealing member provided between the pair of substrates on the periphery thereof;

a plurality of barrier ribs arranged parallel to each other in a striped configuration in a display area in the electric discharge space for partitioning the electric discharge space; and a gas flow barrier for hindering gas flow provided in a non-display area defined between the display area and the sealing member, wherein a space formed between the gas flow barrier and an interior surface of the sealing member is smaller than a space formed between adjacent barrier ribs.

16. A gas discharge panel comprising:

a pair of substrates defining an electric discharge space therebetween, at least one of the substrates having two or more vent holes formed in a periphery area thereof;

a sealing member provided between the pair of substrates on the periphery thereof;

a plurality of barrier ribs arranged parallel to each other in a striped configuration within a display area in the electric discharge space, defining a gas flow passage within the electric discharge space; and at least two gas flow barriers arranged in a non-display area within the electric discharge space and being positioned relative to the vent holes, sealing member, and barrier ribs such that gas flow conductance in a section of the gas flow passage between adjacent barrier ribs is greater than gas flow conductance in a section of the gas flow passage between an interior side of the sealing member and an adjacent barrier rib.

* * * * *